US005407318A

United States Patent [19]

Ito et al.

[11] Patent Number: 5,407,318

[45] Date of Patent: Apr. 18, 1995

[54] REGENERATIVE PUMP AND METHOD OF MANUFACTURING IMPELLER

[75] Inventors: Motoya Ito, Anjo; Yukio Inuzuka, Aichi, both of Japan

[73] Assignee: Nippondenso Co., Ltd., Kariya, Japan

[21] Appl. No.: 161,568

[22] Filed: Dec. 6, 1993

[30] Foreign Application Priority Data

Dec. 8, 1992 [JP] Japan ..... 4-327714
Oct. 12, 1993 [JP] Japan ..... 5-254135

[51] Int. Cl.[6] ..... F04D 17/06
[52] U.S. Cl. ..... 415/55.1
[58] Field of Search ..... 415/55.1, 55.2, 55.3, 415/55.4, 55.5

[56] References Cited

U.S. PATENT DOCUMENTS 2,042,499 6/1936 Brady ..... 415/55.1
3,359,908 12/1967 Toma .
3,734,697 5/1973 Sieghartner .
4,493,620 1/1985 Takei et al. .
5,123,809 6/1992 Ito .

FOREIGN PATENT DOCUMENTS 374652 5/1854 Belgium .
736827 11/1932 France .
2101576 3/1972 France .
3209763 12/1982 Germany .
4020521 1/1992 Germany .
57-81191 5/1982 Japan .
57-97097 6/1982 Japan .
57-99298 6/1982 Japan .
57-206795 12/1982 Japan .
210288 9/1986 Japan ..... 415/55.1
61-210288 9/1986 Japan .
63-63756 12/1988 Japan .
3-2720 1/1991 Japan .
2218748 11/1989 United Kingdom ..... 415/55.1

OTHER PUBLICATIONS

Patent Abstract of Japan, vol. 6 No. 167(M-153)(1045) Aug. 1982 JP-A 57 81191.

*Primary Examiner*—John T. Kwon
*Attorney, Agent, or Firm*—Cushman, Darby & Cushman

[57] ABSTRACT

A regenerative pump according to the present invention includes a rotatable impeller disposed in a housing. The impeller has a plurality of radially extending vane members spaced apart about a periphery of the impeller. Each vane member has circumferentially-facing upstream and downstream surfaces, relative to an operational direction of impeller rotation. At least one of the upstream and downstream surfaces of each vane member has a proximal portion which is inclined or curved away from the operational rotation direction, and a distal portion which is inclined or curved towards the operational rotation direction. The curved/inclined surface advantageously enhances pump efficiency.

36 Claims, 20 Drawing Sheets

REGENERATIVE PUMP AND METHOD OF MANUFACTURING IMPELLER

BACKGROUND OF THE INVENTION

The present invention relates to a regenerative pump in which a configuration of an impeller is improved, and a method of manufacturing the impeller of the regenerative pump Generally, a regenerative pump is used as a small-sized pump which delivers a small amount of liquid of a low viscosity under a high pumping pressure, for example, a fuel pump for an automobile. Such a fuel pump includes a motor. It is driven by electricity generated by an alternator. Therefore, to satisfy present social demands such as saving of natural resources and environmental protection, reduction of fuel consumption (decrease of the alternator load) by improving the pumping efficiency has been an important technical problem in recent years.

A conventional regenerative pump is shown in FIGS. 34 and 35. An impeller 11 is received in a pump flow passage 13 in a casing 12, and rotated. A large number of vane members 14 are formed on the outer periphery of the impeller 11, and each vane groove 15 between adjacent two of the vane members 14 is divided axially into two by a partition wall 16. When the impeller 11 is rotated in a direction indicated by an arrow R, a fluid which has been drawn in the pump flow passage 13 receives kinetic energy from the vane members 14 and is delivered, under a pressure, in the pump flow passage 13 toward a discharge port. At that time, the fluid in each of the vane grooves 15 receives a rotational centrifugal force and flows in the vane groove toward the outer periphery, as shown by an arrow B1. Then, as shown by an arrow B2, the fluid collides against the inner wall of the pump flow passage 13 and its flowing direction is reversed. Further, the fluid flow indicated by the arrow B2 enters into another vane groove 15 on the downstream side (on the reverse side of the rotating direction) from the side surface of the impeller, and flows again toward the outer periphery. By repeating such flows, whirling flows are formed, and the fluid is pressurized and delivered toward the discharge port while whirling in the pump flow passage 13. The flows indicated by the arrows B1 and B2 in FIG. 34 are flows as viewed in a rotational coordinate system fixed on the impeller 11.

In the case of the above-described regenerative pump, the whirling flows in the pump flow passage are known to give a large influence to the pumping efficiency. In order to enhance the pumping efficiency, it is an important factor to generate whirling flows in the pump flow passage smoothly and to continue to generate and strengthen them.

With the conventional structure, however, the whirling flow indicated by the arrow B2 collides against the bottom end portion of the vane member 14 at an angle close to 90° when it enters into the vane groove 15 from the side surface of the impeller. In consequence, the speed of the whirling flow is largely lowered by the bottom end portion of the vane member 14 so that the whirling flow can not enter smoothly into the vane groove 15.

Moreover, the whirling flow indicated by the arrow B2 moves out of the vane groove 15 in a radial direction of the impeller irrespective of the fact that the rotating direction of the impeller and the flowing direction of the fuel are the direction indicated by the arrow R. Therefore, the centrifugal force when the fuel flows out of the vane groove 15 can not be exerted effectively in the flowing direction of the fuel.

Furthermore, the distal end surfaces of the partition walls 16 extend to the outermost periphery of the impeller 11, so that an area which the whirling flows do not reach is formed between the distal end surfaces of the partition walls 16 and the wall surface of the pump flow passage, and that reverse flows are generated in this area, thereby deteriorating the pumping efficiency.

A fuel pump disclosed in, for example, Japanese Patent Examined Publication No. 63-63756 is known for using the regenerative pump shown in FIGS. 34 and 35.

Various shapes of impellers have conventionally been suggested as means for solving the problems of the above-described regenerative pump.

For example, a structure in which vane grooves are inclined in a direction reverse to the rotating direction, i.e., a structure in which whole vane grooves are inclined backwardly from the rotating direction is disclosed in Japanese Patent Unexamined Publication No. 57-99298.

A structure in which vane grooves are inclined and a structure in which vane grooves are formed in a spiral shape are disclosed in Japanese Patent Unexamined Publication No. 57-206795.

In Japanese Patent Unexamined Publication No. 61-210288, a structure in which partition walls are lower than vane members is disclosed.

Further, in Japanese Patent Unexamined Publications Nos. 57-81191, 57-97097 and 4-228899, impellers of blowers are disclosed, and a structure in which distal end portions of blades are inclined forwardly with respect to the rotating direction and a structure in which partition walls are lower than the distal end surfaces of the blades are disclosed.

However, in the structure in which the whole vane grooves are inclined backwardly from the rotating direction, as disclosed in Japanese Patent Unexamined Publication No. 57-99298 or 57-206795, a fluid flows out of the vane grooves in a direction backward from the rotating direction, and it is difficult to apply kinetic energy to the fluid to move toward a discharge port effectively.

Also, in the case of the vane grooves formed in a spiral shape which are disclosed in Japanese Patent Unexamined Publication No. 57-206795, a fluid flows out of the vane grooves in a direction backward from the rotating direction, and consequently, it is difficult to apply kinetic energy to the fluid to move toward a discharge port effectively.

In the structure disclosed in Japanese Patent Unexamined Publication No. 61-210288, vane members shaped like flat plates are still employed, and therefore, a fluid flows in and out of the vane grooves inefficiently in substantially the same manner as in the above-described conventional technique.

The configurations disclosed in Japanese Patent Unexamined Publications Nos. 57-81191, 57-97097 and 4-228899 involve a problem that a fluid does not flow into the vane grooves smoothly since only the distal end portions of the blades are inclined forwardly with respect to the rotating direction. Further, although these configurations are highly effective when they are used for a blower, a high efficiency can not be obtained in the case of an incompressible fluid such as fuel.

When partition walls are lower than vane members, the strength of the vane members is degraded. Especially, when an impeller is molded of a resin, it is feared that the vane members will be broken during grinding of the outer periphery of the impeller, thereby decreasing the yield. Moreover, when distal end surfaces of vane members are inclined backwardly from or forwardly to the rotating direction, it is feared that stress applied to the vane members during grinding of the outer periphery of the impeller will be increased and the vane members will be broken, thereby decreasing the yield.

SUMMARY OF THE INVENTION

The present invention has been achieved in consideration of the problems of the conventional techniques. It is an object of the invention to improve both flows of a fluid in and out of vane grooves so as not to hinder whirling flows in a pump flow passage and to apply kinetic energy to the fluid in the pump flow passage effectively, thereby enhancing the pumping efficiency.

It is another object of the invention to manufacture an impeller in which flows of a fluid out of vane grooves are improved to apply kinetic energy to the fluid in a pump flow passage effectively, while reducing the breakage of vane members.

In order to achieve the above object, a regenerative pump according to the invention comprises a casing including a suction port, a discharge port and a pump flow passage of an arcuate shape which connects these ports, and a disk-like impeller rotatably housed in the casing and formed with a large number of vane members at a position corresponding to the pump flow passage. In this pump, the upstream-side or downstream-side vane surface of each of the vane members comprises a plane section located on the bottom end side of the vane member and inclined backwardly from a rotating direction of the impeller, and a plane section located on the outer peripheral side of the vane member and inclined forwardly with respect to the rotating direction of the impeller.

A manufacturing method of an impeller of a regenerative pump for pressurizing and supplying a fluid according to the invention, comprises a resin molding step to mold the disk-like impeller of a resin, the impeller including a large number of vane members formed on the outer periphery in such a manner that outer peripheral portions of the vane members are inclined in one circumferential direction, and an outer-periphery grinding step to grind distal end surfaces of the vane members of the impeller molded in the resin molding step, by moving a tool relatively onto the distal end surfaces of the impeller, in a direction along the inclination direction of the vane members.

According to another aspect of the invention, there is provided a manufacturing method of a regenerative pump with an impeller including a fitting hole in which a rotational shaft is inserted and closely fitted to transmit the rotation, rotation of the impeller being limited to a predetermined direction. This method comprises a step to form a tapered surface on an opening portion of the fitting hole substantially only on one side, and an assembly step to insert the rotational shaft in the fitting hole from the tapered surface side, to place the impeller in a casing and to accord a rotating direction of the impeller with the predetermined direction.

According to a still other aspect of the invention, there is provided a fuel pump which is provided in a fuel tank of an automobile and pressurizes fuel and supplies it to an internal combustion engine. This fuel pump comprises a cylindrical housing, a pump portion which is provided on one end of the housing, and draws fuel from the fuel tank and discharges it into the housing, a motor portion which is provided in the housing, and rotates/drives the pump portion, and a fuel discharge port which is provided on the other end of the housing, and discharges the fuel which has been discharged from the pump portion and passed inside of the housing. The pump portion comprises a casing in which a pump flow passage of an arcuate shape is formed, the pump flow passage including a suction port which is formed on one end thereof and communicates with the fuel tank, and a discharge port which is formed on the other end thereof and communicates with the inside of the housing, and a disk-like impeller which is rotatably housed in the casing and rotated/driven by the motor portion. This impeller comprises a plurality of individual vane members between which vane grooves are formed, each of the vane members including a vane surface facing the downstream side of the pump flow passage, and a vane surface facing the upstream side of the pump flow passage, the downstream-side vane surface and the upstream-side vane surface being curved in such a manner that portions of the vane surfaces on the bottom end side of the vane member are inclined backwardly from a rotating direction of the impeller, and that portions of the vane surfaces on the outer peripheral side of the vane member are inclined forwardly with respect to the rotating direction of the impeller, and partition walls each of which divides a groove between adjacent two of the vane members into a first groove section facing one end surface of the impeller, a second groove section facing the other end surface of the impeller, and a communication groove section which connects the first and second groove sections axially at the outer peripheral side.

In the above-described structure, the bottom end portion of each vane member is inclined backwardly from the rotating direction of the impeller, so that when a whirling flow which enters into a vane groove from the side surface of the impeller collides against the bottom end portion of the vane member, the angle $\theta 0$ defined between the bottom end portion of the vane member and the whirling flow (see FIG. 8) is decreased to allow the whirling flow to enter into the vane groove smoothly.

Further, the distal end portions of the vane members are inclined forwardly with respect to the rotating direction, so that the vane members can effectively apply kinetic energy for moving in the rotating direction, to the fluid which has flowed into the vane grooves, to thereby enhance the pumping efficiency by a remarkable degree.

According to the manufacturing method of the impeller of the invention, the distal end surfaces of the vane members of the impeller are ground by moving a tool relatively onto the distal end surfaces of the impeller, in a direction along the inclination direction of the vane members, and consequently, stress applied to the vane members at the time of grinding work is decreased by the inclination of the impeller, thus reducing the breakage of the vane members.

DESCRIPTION OF THE EMBODIMENTS

A first embodiment of a regenerative pump of the invention which is applied to a fuel pump for an automobile will be hereinafter described with reference to the attached drawings.

Figure 1:
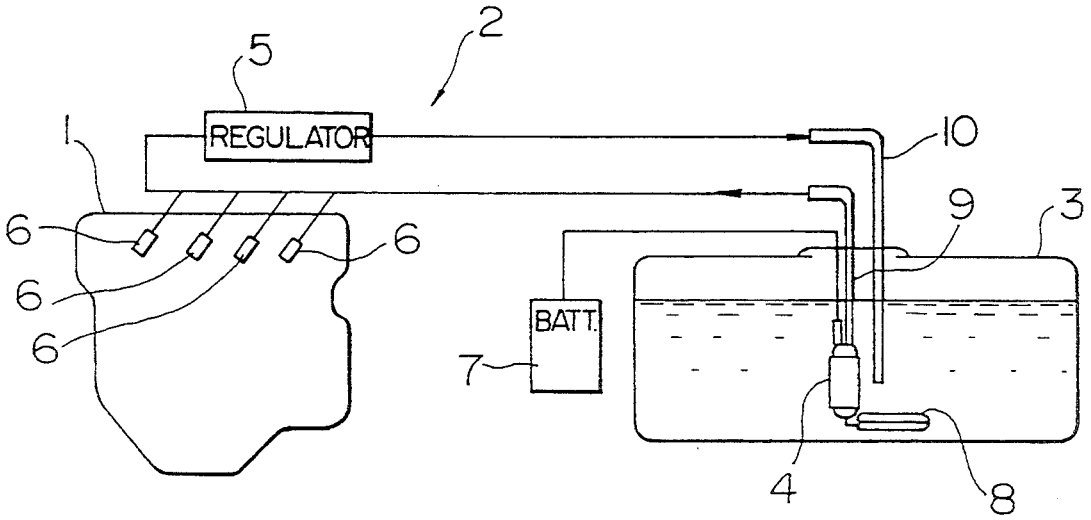
FIG. 1 is a view schematically showing a structure of a fuel supply apparatus for a vehicle.

FIG. 1 is a view schematically showing the structure of a fuel supply apparatus 2 for an automobile engine 1.

The fuel supply apparatus 2 comprises a fuel pump 4 provided in a fuel tank 3, a regulator 5 for regulating a pressure of fuel discharged from the fuel pump 4, injectors 6 for injecting and supplying the fuel to cylinders of the engine 1, and pipes for connecting these components. When supplied with power from a battery 7 mounted on the automobile, the fuel pump 4 is actuated to draw fuel through a filter 8 and discharge it into a discharge pipe 9. On the other hand, excess fuel discharged from the regulator 5 is returned into the fuel tank 3 by way of a return pipe 10.

Next, a structure of the fuel pump 4 will be described.

Figure 2:
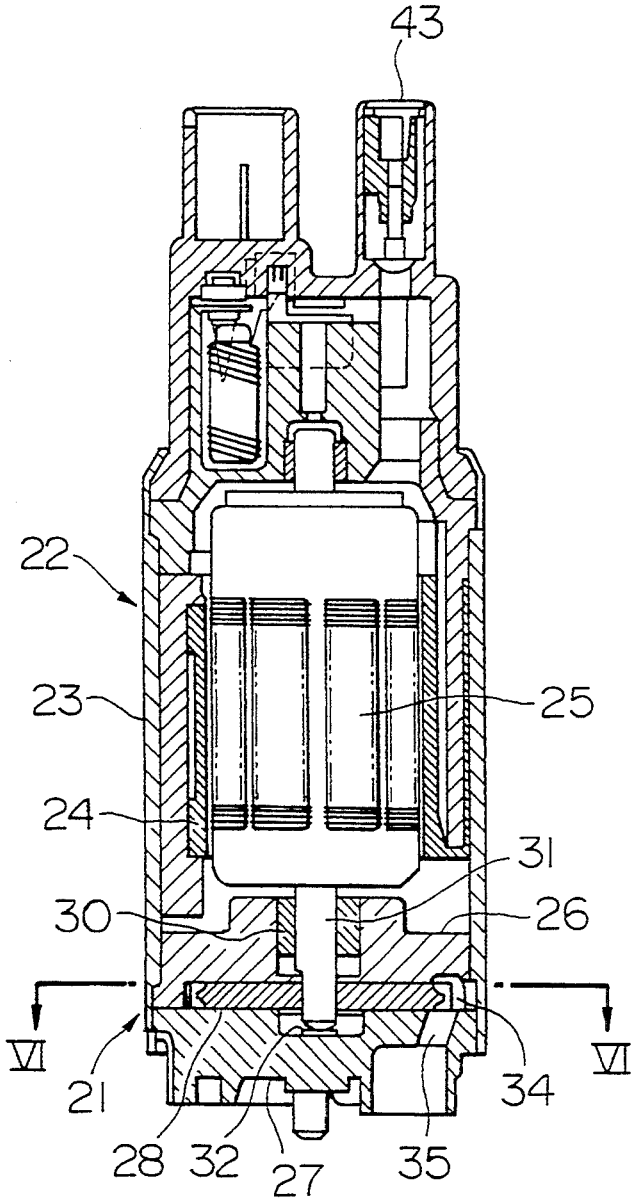
FIG. 2 is a vertical cross-sectional view of a fuel pump to which a regenerative pump according to a first embodiment of the invention is applied.

FIG. 2 is a vertical cross-sectional view of the fuel pump 4.

The fuel pump 4 comprises a pump portion 21 and a motor portion 22 for driving the pump portion 21. The motor portion 22 is a direct-current motor with a brush and has the structure in which permanent magnets 24 are provided, in an annular form, in a cylindrical housing 23, and an armature 25 is provided concentrically on the inner peripheral side of the permanent magnets 24.

The pump portion 21 will now be described.

Figure 3:
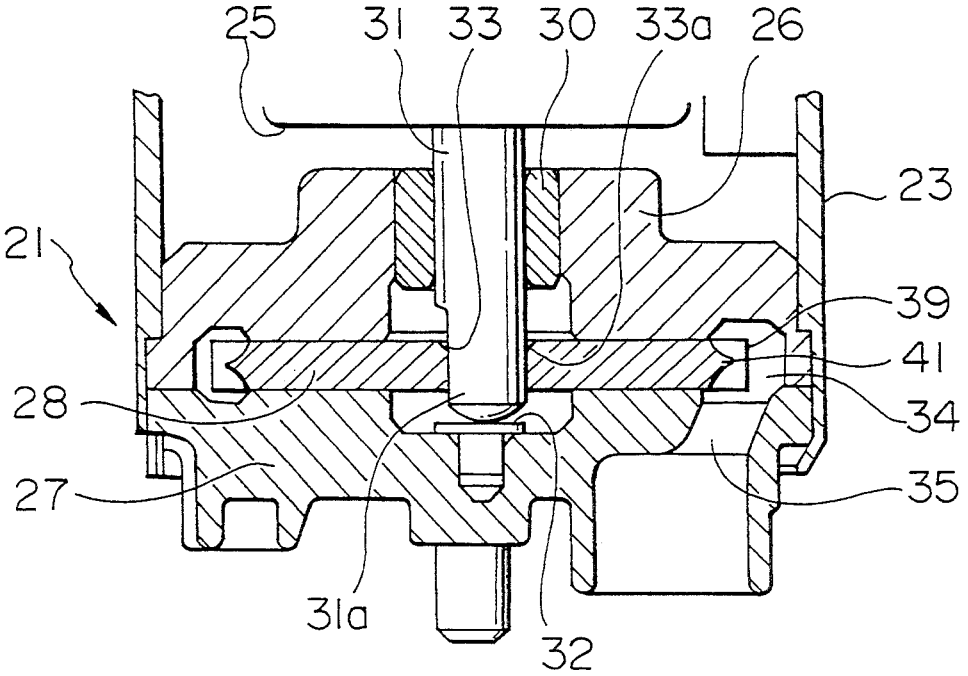
FIG. 3 is an enlarged cross-sectional view showing a pump portion of the fuel pump of FIG. 2.
Figure 4:
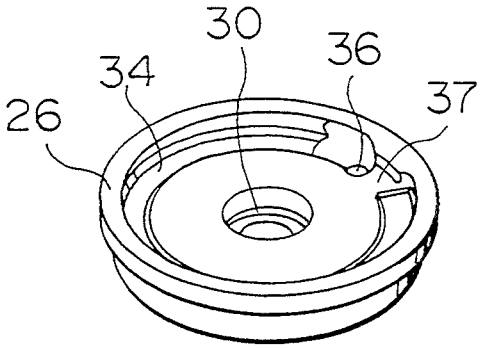
FIG. 4 is a perspective view showing a casing body of the pump portion of FIG. 3.
Figure 5:
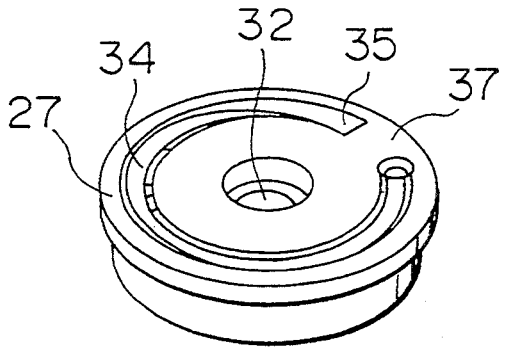
FIG. 5 is a perspective view showing a casing cover of the pump portion of FIG. 3.

FIG. 3 is an enlarged view of the pump portion 21; FIG. 4 is a perspective view of a casing body 26; FIG. 5 is a perspective view of a casing cover 27; and FIG. 6 is a cross-sectional view taken along the line VI—VI of FIG. 2, as viewed in a direction of the arrows.

As shown in FIG. 3, the pump portion 21 comprises the casing body 26, the casing cover 27, an impeller 28 and so forth. The casing body 26 and the casing cover 27 are formed by, for instance, die casting of aluminum. The casing body 26 is press-fitted in one end of the housing 23. A rotational shaft 31 of the armature 25 is penetrated through and supported in a bearing 30 which is secured in the center of the casing body 26. On the other hand, the casing cover 27 is placed over the casing body 26 and fixed in the one end of the housing 23 in this state by caulking or the like. A thrust bearing 32 is fixed in the center of the casing cover 27 so as to receive a thrust load of the rotational shaft 31. The casing body 26 and the casing cover 27 constitute a sealed casing in which the impeller 28 is rotatably housed.

Figure 6:
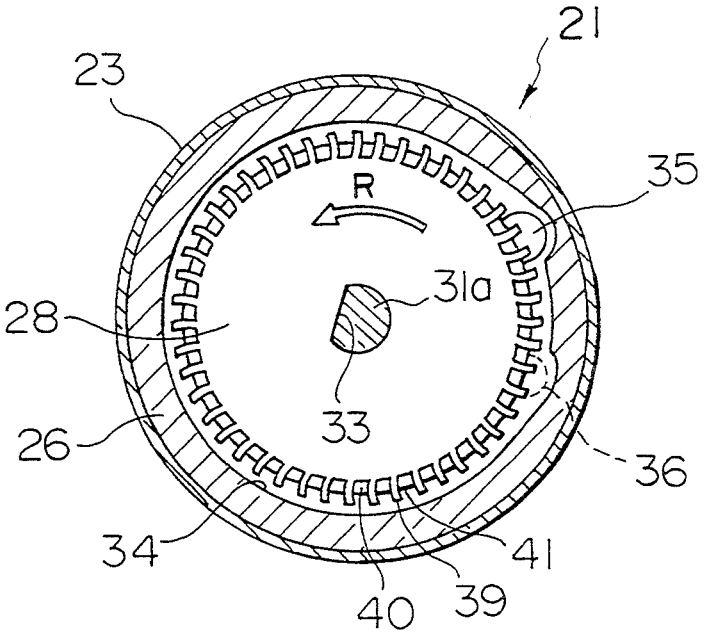
FIG. 6 is a cross-sectional view taken along the line VI—VI of FIG. 2, as viewed in a direction of the arrows.

As shown in FIG. 6, a substantially D-shaped fitting hole 33 is formed in the center of the impeller 28, and is closely fitted on a D-cut portion 31*a* of the rotational shaft 31. Consequently, although the impeller 28 rotates integrally with the rotational shaft 31, it is slightly movable in the axial direction.

Also, a slight portion of the motor-side surface of the fitting hole 33 is formed into a tapered surface 33*a* which is used for discriminating the right side of the impeller 28.

As shown in FIGS. 4 and 5, a pump flow passage 34 of an arcuate shape is defined between the casing body 26 and the inner surface of the casing cover 27. Further, a suction port 35 communicating with one end of the pump flow passage 34 is formed in the casing cover 27 whereas a discharge port 36 communicating with the other end of the pump flow passage 34 is formed in the casing body 26. A partition portion 37 for preventing reverse flows of fuel is formed between the suction port 35 and the discharge port 36. The discharge port 36 is penetrated through the casing body 26 and connected to a space inside of the motor portion 22. Therefore, fuel discharged through the discharge port 36 passes the space inside of the motor portion 22 and is discharged through a fuel discharge port 43 (see FIG. 2) formed in the other end of the housing 23. On the other hand, the filter 8 (see FIG. 1) is attached outside of the suction port 35.

Next, a configuration of the impeller 28 which is a characteristic part of the invention will be described.

Figure 7:
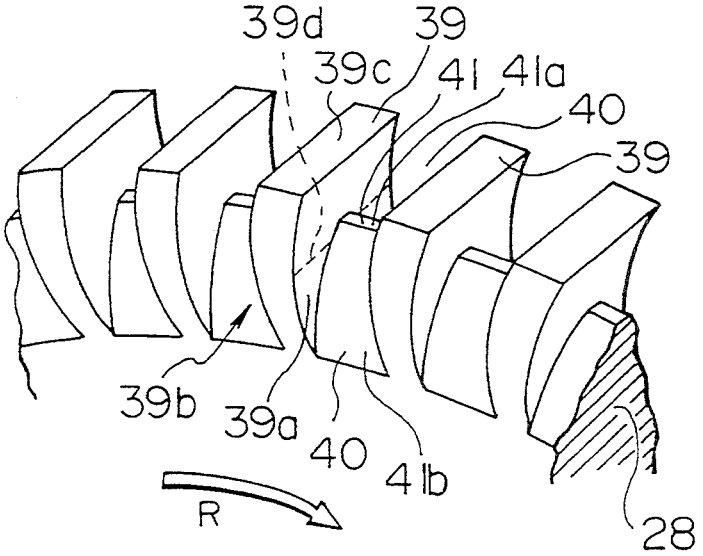
FIG. 7 is a partially cut-away perspective view of the impeller of the first embodiment.
Figure 8:
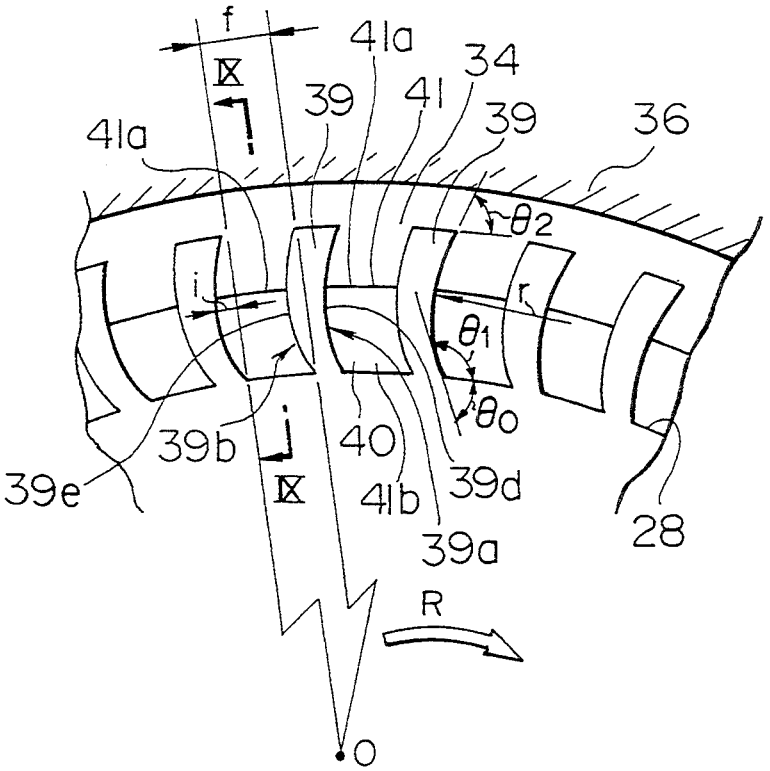
FIG. 8 is an enlarged plan view partially showing the impeller of FIG. 7 when it is installed in a casing.
Figure 9:
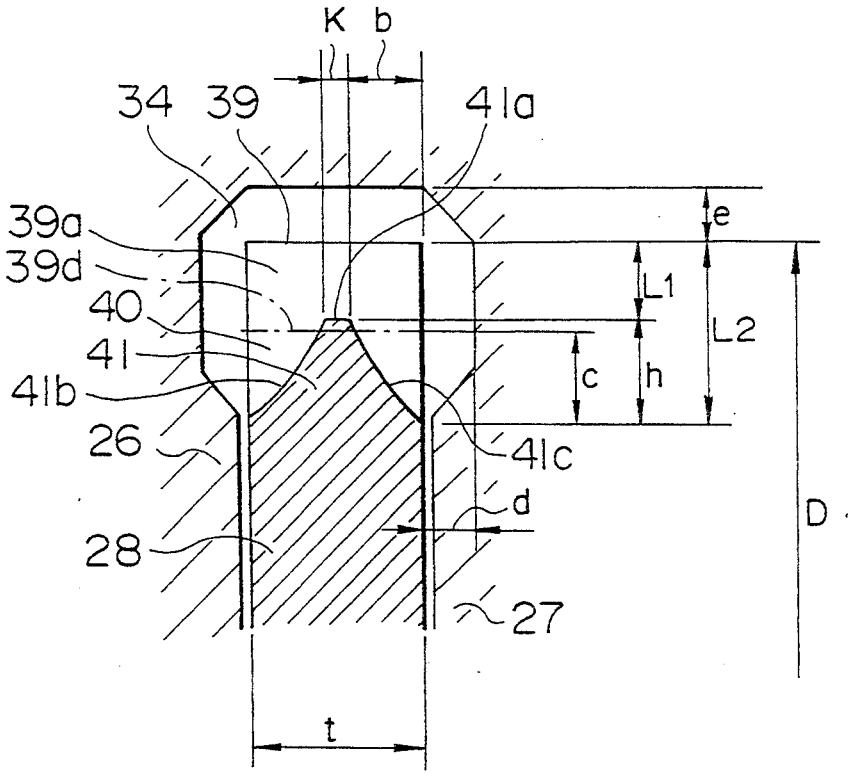
FIG. 9 is a cross-sectional view taken along the line IX—IX of FIG. 8, as viewed in a direction of the arrows.

FIG. 7 is a partially cut-away perspective view of the impeller 28. FIG. 8 is an enlarged plan view partially showing the impeller when it is provided in the casing, and FIG. 9 is a cross-sectional view taken along the line IX—IX of FIG. 8, as viewed in a direction of the arrows.

The impeller 28 is formed of, for example, a phenolic resin including glass fibers, PPS or the like. The impeller 28 is manufactured by resin molding and grinding of both the end surfaces and the outer peripheral surface of the impeller.

As shown in FIG. 7, a large number of vane members 39 are formed on an outer peripheral portion of the impeller 28. Also, partition walls 41 are formed to divide each vane groove 40 between the vane members 39 axially into two. Each of the partition walls 41 defines a first groove section facing one of the end surfaces of the impeller, a second groove section facing the other of the end surfaces of the impeller, and a communication groove section for axially connecting the first and second groove sections at the outer periphery. As a result, as shown in FIG. 9, U-shaped vane grooves 40 are obtained. Each of the vane members 39 includes a vane surface 39*a* at the downstream side of the impeller rotating direction and a vane surface 39*b* at the upstream side of the same, and both the vane surfaces 39*a* and 39*b* are curved to have arcuate shapes, as shown in FIGS. 7 and 8. Besides, the outer peripheral end and the bottom end of each of the vane surfaces 39*a*, 39*b* are located at positions on a diametral line passing the center O of the impeller 28.

Especially, the bottom end portion of each vane surface 39*a*, 39*b* is inclined backwardly from the rotating direction R of the impeller 28 so that an angle $\theta 1$ defined between the bottom end portion of each vane surface 39*a*, 39*b* and a line tangent to the circumference of the impeller 28 is larger than 90°.

The distal end side of each vane surface 39*a*, 39*b* is inclined forwardly with respect to the rotating direction R so that an angle $\theta 2$ defined between the distal end side of each vane surface 39*a*, 39*b* and a line tangent to the circumference of the impeller 28 is smaller than 90°.

Further, each vane member 39 is shaped to have a thickness gradually increased toward the outer periphery so that the width of each vane groove 40 on the inner peripheral side is equal to that on the outer peripheral side.

Moreover, the distal end surface 41*a* of the partition wall 41 is located on the inner peripheral side of the distal end surface 39*c* of each vane member 39 so that fuel flows along bottom surfaces 41*b* and 41*c* of the partition wall 41 on both sides will join each other on the vane surface 39*a*. Besides, the distal end surface 41*a* of the partition wall 41 is located on the outer peripheral side of the deepest central portion 39*d* of the vane surface 39*a*, and also is located on the outer peripheral side of the outermost central portion 39*e* of the vane surface 39*b*.

In the first embodiment, the components of the regenerative pump have the following dimensions specified in Tables 1 and 2.

TABLE 1

| DIAMETER D mm | THICKNESS t mm | AXIAL GAP d mm | RADIAL GAP e mm | VANE COMMNICATION-PORTION LENGTH L1 mm | ENTIRE VANE LENGTH L2 mm | PARTITION WALL HEIGHT h mm | VANE CENTRAL-PORTION DISTANCE c mm |
|---|---|---|---|---|---|---|---|
| 30 | 2.3 | 0.6 | 0.7 | 1.0 | 2.1 | 1.1 | 1.2 |

TABLE 2

| VANE GROOVE DEPTH b mm | PARTITION-WALL DISTAL-END WIDTH k mm | VANE GROOVE WIDTH f mm | VANE-MEMBER CURVATURE RADIUS r mm | BOTTOM END PORTION ANGLE θ1 DEGREES | DISTAL END PORTION ANGLE θ2 DEGREES | VANE-MEMBER CURVATURE HEIGHT i mm | NUMBER OF VANE MEMBERS |
|---|---|---|---|---|---|---|---|
| 1.0 | 0.3 | 1.2 | 2.5 | 111 | 64 | 0.25 | 47 |

As shown in FIG. 8, the vane groove width f represents a lateral width of the vane groove 40; the curvature radius r represents a curvature radius of the vane surface 39*a*, 39*b*; and the curvature height i represents a perpendicular distance from a straight line connecting both end portions of the vane surface 39*a* to the central portion (the deepest portion) 39*d* of the vane surface 39*a*. As shown in FIG. 9, the diameter D denotes a diameter of the impeller 28; the thickness t denotes an axial thickness of the impeller 28; the vane communication-portion length L1 denotes a radial length of the vane member 39 extending from the distal end surface 41*a* of the partition wall 41 toward the outer periphery; and the entire vane length L2 denotes a radial length between the bottom end portion of the vane member 39 and the outer peripheral surface 39*c*. Also, as shown in FIG. 9, the partition wall height h denotes a radial distance between the bottom end portion of the vane member 39 and the distal end surface 41*a* of the partition wall 41; the central portion distance c denotes a radial distance between the deepest central portion 39*d* of the vane surface 39*a* and the bottom end portion of the vane member 39; and the vane groove depth b denotes an axial distance between the distal end of the bottom surface 41*c* and the side end surface of the impeller 28. Further, as shown in FIG. 9, the axial gap d represents a distance between the side end surface of the impeller 28 and the bottom surface of the pump flow passage 34; and the radial gap e represents a distance between the outer peripheral surface 39*c* of the vane member 39 of the impeller 28 and the outer peripheral surface of the pump flow passage 34.

The operation of the above-described embodiment will now be described.

When the motor portion 22 is supplied with power and the armature 25 is rotated, the impeller 28 is rotated in the direction indicated by the arrow R integrally with the rotational shaft 31 of the armature 25. Thus, the vane members 39 on the outer periphery of the impeller 28 move in the arcuate pump flow passage 34 so as to cause a pumping function. Due to this pumping function, fuel in the fuel tank 3 is drawn from the suction port 35 through the filter 8 into the pump flow passage 34, flows through the pump flow passage the discharge port 36, passes the motor portion 22 and is discharged from the discharge port 43.

In this case, the above-mentioned pumping function is obtained from movement of the fuel caused by moving the vane members 39 and movement of the fuel in the vane grooves 40 by the centrifugal force which exerts kinetic energy to it. In response to the centrifugal force, the fuel in the vane grooves 40 starts to flow toward the outer periphery in the vane grooves 40, collides against the inner wall of the pump flow passage 34, and is divided into two flows. Then, after flowing along the inner wall of the pump flow passage 34, the fuel flows into the vane grooves 40 from the bottom end side of the vane members 39 again and further receives the centrifugal force. In this manner, two whirling flows along the bottom surfaces 41*b* and 41*c* of the partition walls 41 of the impeller 28 are formed, and these whirling flows are strengthened while repeating flowing in and out of the vane grooves 40.

In order to increase the pumping efficiency, this regenerative pump must be designed in such a manner that fuel will easily flow into each of the vane grooves 40 from the side surface of the impeller, and that each of the vane members 39 will effectively apply kinetic energy in the rotating direction R, to the fuel.

From this point of view, in this embodiment, as shown in FIG. 8, the bottom end portion of each vane member 39 is inclined backwardly from the rotating direction R of the impeller 28 so that the angle θ1 defined between the bottom end portion of the vane member 39 and a line tangent to the circumference of the impeller 28 is larger than 90°, and the distal end side of each vane member 39 is inclined forwardly with respect to the rotating direction R so that the angle θ2 defined between the distal end side of the vane member 39 and a line tangent to the circumference of the impeller 28 is smaller than 90°. In this case, by inclining the bottom end portion of each vane member 39 backwardly, an angle 80 defined between a whirling flow flowing into the vane groove 40 from the side surface of the impeller and the bottom end portion of the vane member 39 (see FIG. 8) becomes smaller, to thereby induce the whirling flow to flow into the vane groove 40 smoothly. Moreover, by inclining the distal end side of each vane member 39 forwardly to the rotating direction R, the fuel which has flowed in the vane groove 40 moves forwardly in the rotating direction of the impeller 28 when it flows out of the vane groove 40 toward the outer periphery. Therefore, the flow velocity of the fuel flowing in the pump flow passage 34 from the suction port to the discharge port can be made closer to the rotational speed of the impeller 28. In other words, from the vane members 39, kinetic energy can be effectively applied to the fuel which has flowed in the vane grooves 40, thus enhancing the pumping efficiency effectively.

The inventors of the present application tested a large number of trial products and investigated their effects so as to determine the optimum dimensions specified in the first embodiment. Dimensions of a large number of trial products and their effects will now be described to show characteristics of the invention more clearly. It should be noted that when the pumping efficiency was calculated in the test, a pump input was obtained from a product of a load torque and a rotational speed, and a pump output was obtained from a product of a discharge pressure and a discharge flow rate. The discharge pressure was measured by a Digital Multi-meter manufactured by Advantest Corp. and a small-sized semiconductor pressure sensor manufactured by Toyoda Machine Works, Ltd., and the discharge flow rate was measured by a Digital Flowmeter manufactured by Ono Sokki K.K.

Test results of trial products D1 to D7 varying in the curvature radius of the vane members 39 will be described with reference to FIGS. 10A to 10D. Dimensions of a regenerative pump used for the test were substantially the same as the dimensions specified in Tables 1 and 2 except that the entire vane length L2 was 2.4 mm and the curvature r varied.

Figure 10A:
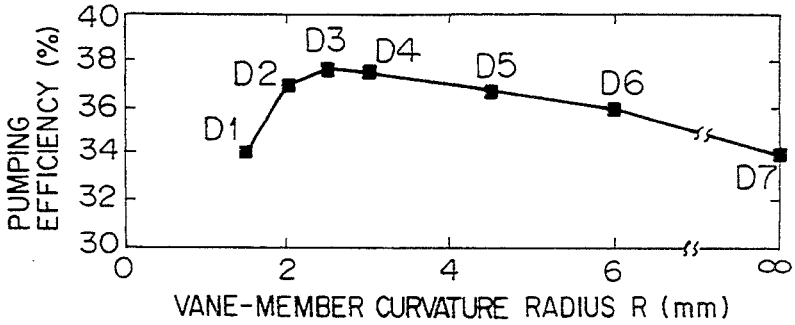
FIG. 10A is a graph illustrative of a relationship between the curvature radii r of vane surfaces of vane members and the pumping efficiencies.

FIG. 10A is a graph illustrative of the relationship between the curvature radius r of the vane surfaces 39*a* and 39*b* of the vane members 39 and the pumping efficiencies. As obviously understood from FIG. 10A, when the curvature radius r of the side surfaces of the vane members 39 is infinite (corresponding to that of a conventional product whose vane surfaces are flat), the pumping efficiency is as low as about 34%. However, as the curvature radius r is decreased, the efficiency is gradually raised until it reaches the maximum value when the curvature radius is about 2.2 mm. Especially in a range of r=about 2 mm to about 4 mm, the effect of improvement of the pumping efficiency is remarkably observed. When the curvature radius r is smaller than the range, however, the efficiency is drastically decreased. In order to avoid such a drastic decrease in the efficiency, the curvature radius r should preferably be set at about 2 mm or more. For this reason, the curvature radius r in the above-described embodiment is 2.5 mm and larger than about 2.2 mm with which the maximum efficiency can be obtained.

Figure 10B:
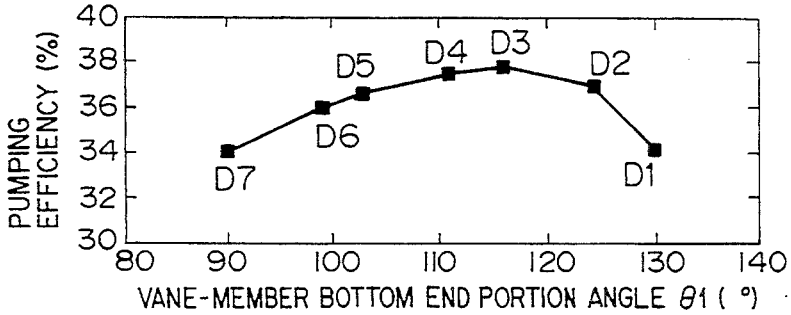
FIG. 10B is a graph illustrative of a relationship between angles $\theta 1$ between bottom end portions of the vane members and the circumferential directions of impellers, and the pumping efficiencies.

FIG. 10B is a graph illustrative of the relationship between the angles $\theta 1$ of the bottom end portions of the vane members of the trial products D1 to D7 and the pumping efficiencies. As obviously understood from FIG. 10B, when $\theta 1=90°$ (corresponding to that of the conventional product), the pumping efficiency is low, but the effect of improvement of the pumping efficiency is remarkably observed in a range of $\theta 1$=about 100° to about 127°. However, when the angle of the vane member bottom end portion is larger than about 125°, however the efficiency is drastically decreased For this reason, the bottom end portion angle $\theta 1$ in the above-described embodiment is 111° and smaller than about 116° with which the maximum efficiency can be obtained.

Figure 10C:
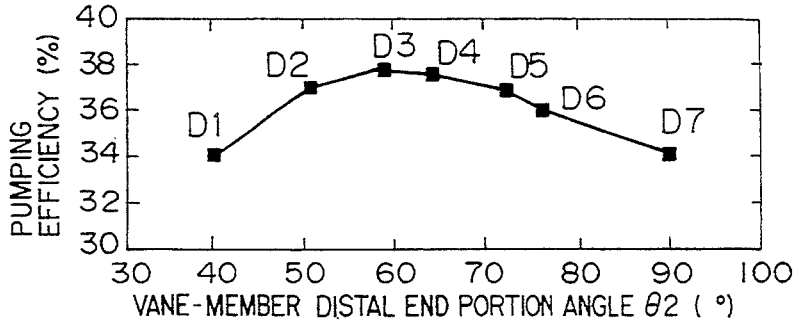
FIG. 10C is a graph illustrative of a relationship between angles $\theta 2$ between distal end portions of the vane members and the circumferential directions of the impellers, and the pumping efficiencies.

FIG. 10C is a graph illustrative of the relationship between the angles $\theta 2$ of the distal end portions of the vane members of the trial products D1 to D7 and the pumping efficiencies. As obviously understood from FIG. 10C, when $\theta 2=90°$ (corresponding to that of the conventional product), the pumping efficiency is low, but the effect of improvement of the pumping efficiency is remarkably observed in a range of $\theta 2$=about 45° to about 76°.

Figure 10D:
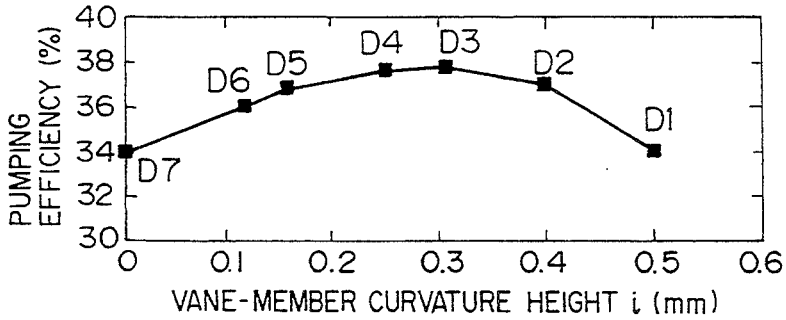
FIG. 10D is a graph illustrative of a relationship between the curvature heights i of the vane members and the pumping efficiencies.

FIG. 10D is a graph illustrative of the relationship between the curvature heights i of the vane members of the trial products D1 to D7 and the pumping efficiencies. As obviously understood from FIG. 10D, when i=0 (corresponding to that of the conventional product), the pumping efficiency is low. However, as the vane curvature height i is increased, the efficiency is gradually raised. When the curvature height exceeds i=0.31 mm with which the maximum pumping efficiency can be obtained, however, the pumping efficiency is drastically decreased. The vane curvature height i should preferably be set at a value smaller than i=0.31 mm with which the maximum efficiency can be obtained, in the range (i=0.1 mm to 0.45 mm) wherein a high pumping efficiency can be obtained.

In each graph of FIGS. 10A to 10D, relations of the trial products are respectively designated by reference characters D1 to D7.

Next, there will be described trial products D8 to D11 whose components had substantially the same dimensions as those of the first embodiment except that the entire vane length L2 was 2.4 mm and the partition wall height varied.

Figure 11:
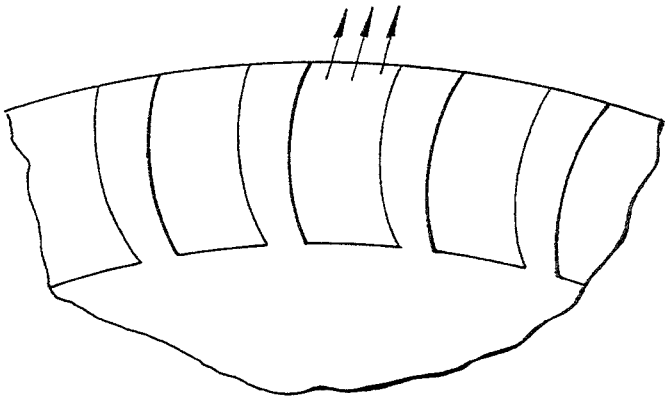
FIG. 11 is an enlarged plan view partially showing an impeller of a trial product.

FIG. 11 is a partial plan view of an impeller of a trial product D8 in which the partition wall height h was equal to the entire vane length L2.

Figure 12:
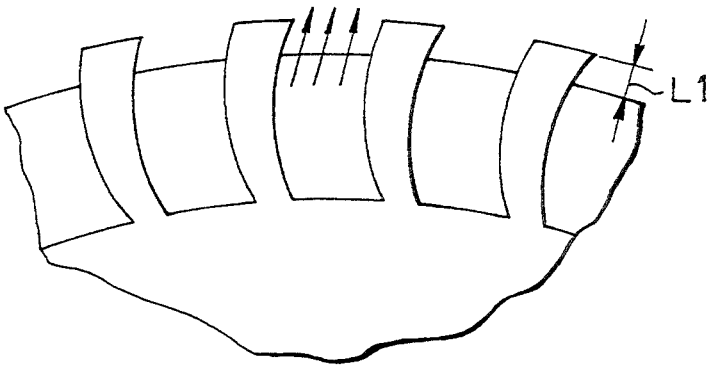
FIG. 12 is an enlarged plan view partially showing an impeller of a trial product.

FIG. 12 is a partial plan view of an impeller of a trial product D9 in which the partition wall height h was 1.9 mm, and the vane communication-passage length L1 was 0.5 mm.

Figure 13:
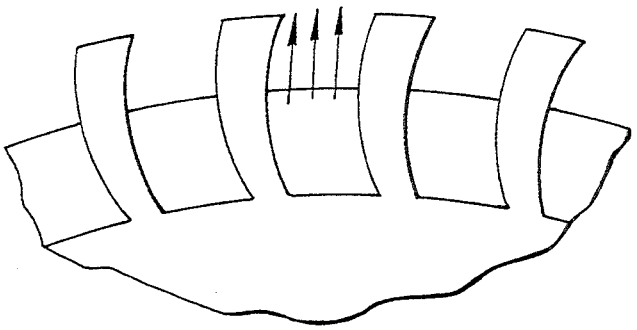
FIG. 13 is an enlarged plan view partially showing an impeller of a trial product.

FIG. 13 is a partial plan view of an impeller of a trial product D10 in which the partition wall height h was 1.5 mm, and the vane communication-passage length L1 was 0.9 mm.

Figure 14:
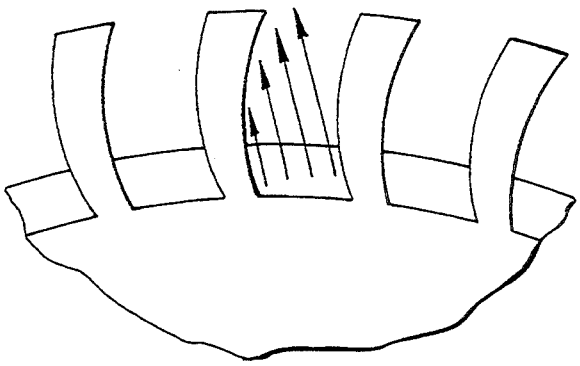
FIG. 14 is an enlarged plan view partially showing an impeller of a trial product.

FIG. 14 is a partial plan view of an impeller of a trial product D11 in which the partition wall height h was 0.9 mm, and the vane communication-passage length L1 was 1.5 mm.

Figure 15:
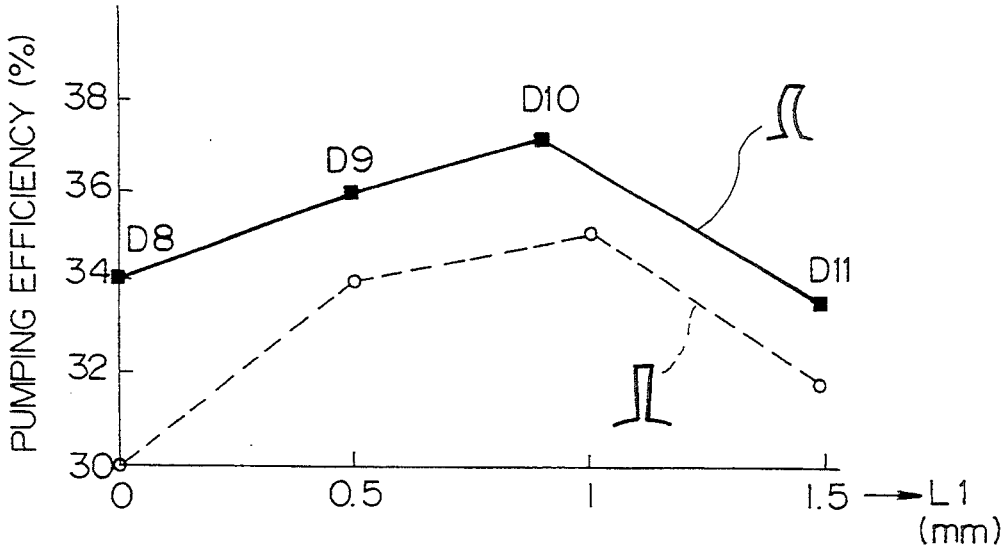
FIG. 15 is a graph illustrative of a relationship between the communication-portion vane lengths L1 and the pumping efficiencies.

In FIG. 15, pumping efficiencies of the above-described trial products D8 to D11 are depicted by a solid line. As understood from the characteristic of FIG. 15, the highest efficiency was obtained in the case of the trial product D10 in which the partition wall height h was 1.5 mm, and the vane communication-passage length L1 was 0.9 mm.

As the partition wall height h is decreased in the direction shown from FIG. 11 to FIG. 13, the pumping efficiency becomes higher. The reason is thought to be that an area of reverse flows generated at the outer periphery of the distal ends of the partition walls is decreased. However, when the partition walls are made too low, as shown in FIG. 14, the efficiency is degraded again. The reason is thought to be that the bottom surfaces of the vane grooves are too small and the function as a guide of flows of fuel in the vane grooves toward the outer periphery is deteriorated, thus causing trouble in the generation of whirling flows. Further, in FIG. 14, directions of flows at the distal end portion of the partition wall are expressed by the arrows. In the case of the impeller whose partition walls are low, as shown in FIG. 14, flows which have not adequately been guided by the bottom surfaces of the vane grooves collide against the curved vane plates at acute angles, so that the loss will be large. Moreover, pumping efficiencies of impellers in which vane plates have flat shapes and heights of partition walls alone vary are depicted by a broken line in FIG. 15. It is understood from comparison of the characteristic of this broken line with that of the above-mentioned solid line that a rate of an increase in the pumping efficiency which can be obtained by curving the vane plates is larger as the partition walls are higher. In this relation, when angles of collision against the vane plates are considered, the distal ends of the partition walls should preferably be located in areas on the outer peripheral side of the deepest portions of the curved vane plates, i.e., areas of the surfaces of the vane plates which are inclined forwardly with respect to the rotating direction.

The impeller including vane members shaped like flat plates is disclosed in Japanese Patent Application No. 5-35405.

The regenerative pump according to the invention is used especially as a fuel pump for supplying fuel to a fuel injection device for a vehicle when it is combined with a direct-current motor. Usually, this fuel pump is required to have a discharge rate of 50 to 200 L/h when a fuel pressure is 2 to 5 kgf/cm$^2$. The fuel pressure is set by the pressure regulator 5 (see FIG. 1) and varies in accordance with a condition of operation of an engine. For instance, the fuel pressure is about 2.5 kgf/cm$^2$ during idling, but it becomes about 3 kgf/cm$^2$ during full-power operation of the engine. Therefore, the fuel pump is expected to be dull in respect of a change of the discharge rate in response to a change in the discharge pressure.

Figure 16:
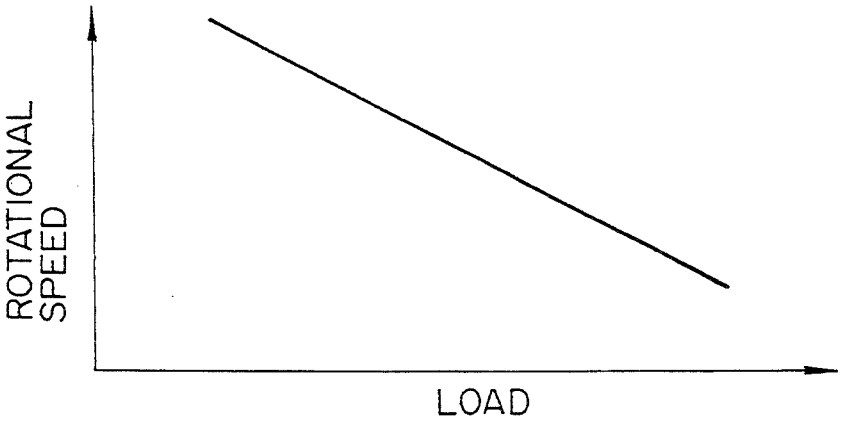
FIG. 16 is a graph illustrative of a general relationship between a load and a rotational speed of a fuel pump for a vehicle.

However, an electric fuel pump for a vehicle for general use is driven by a direct-current motor, and this direct-current motor is operated by a battery mounted on the vehicle. Since this electric fuel pump is operated by a constant voltage of the battery, the rotational speed of the motor portion is decreased owing to properties of the direct-current motor at the time of a high load (when the system pressure of the fuel injection device is high), thereby reducing the discharge rate (see FIG. 16). Further, even if a constant rotational speed of the pump portion is maintained, the discharge rate is reduced because an inside leakage is increased when the pressure is raised. However, a decrease in the discharge rate of the pump portion can be lessened by decreasing the gap between the vanes and the flow passage, i.e., the flow passage representative size Rm, or shortening the vane length. If the Rm or the vane length is decreased by an extreme degree, the discharge rate per rotation of the impeller is reduced, and consequently, the impeller must be operated at a high rotational speed. Therefore, needless to say, the Rm or the vane length can not be decreased by an extreme degree more than necessary.

Figure 17:
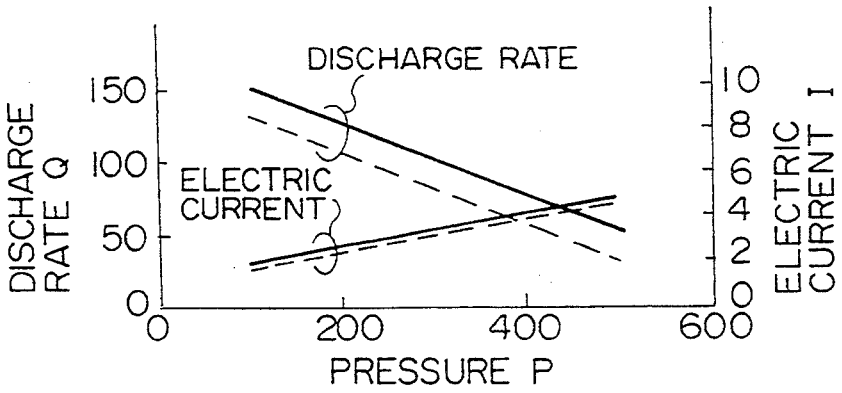
FIG. 17 is a graph illustrative of discharge-rate characteristics and electric-current characteristics of the first embodiment (solid lines) and a conventional product (broken lines)
Figure 18:
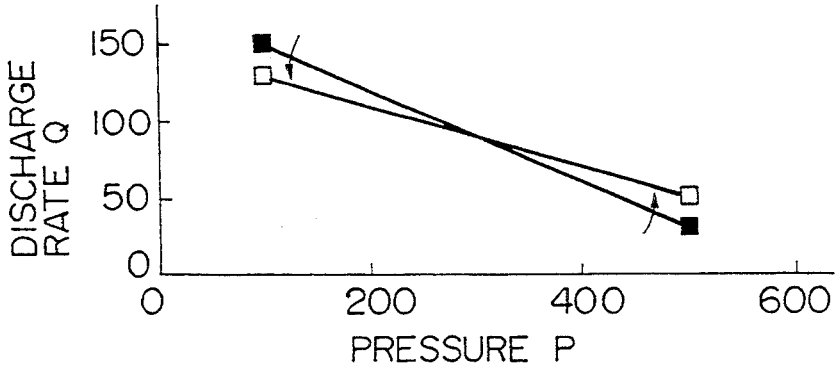
FIG. 18 is a graph for explaining a change to a desirable discharge-rate characteristic.

Evaluation results of pressure characteristics of a fuel pump in which the above-described impeller of the first embodiment is used are shown in FIG. 17. In the figure, broken lines depict results of the conventional product, and solid lines depict results of the first embodiment. As obviously understood from this figure, the electric current value of the first embodiment is substantially the same as that of the conventional product, and the discharge rate of the first embodiment is increased substantially in parallel to that of the conventional product. If the required discharge rate of the fuel pump is equal to that of the conventional product, the discharge rate is made equal to that of the conventional product by decreasing the Rm or shortening the vane length, as described before, to lessen a decrease in the discharge rate when the pressure is raised, i.e., to provide a so-called dull characteristic that the P–Q inclination is small, as shown in FIG. 18.

Moreover, the discharge flow rate of the fuel pump varies depending upon the displacement and the power of the engine. A flow rate of about 50 to 100 L/h (hereinafter referred to as a low flow rate) is required for a small-displacement low-power engine; a flow rate of about 80 to 150 L/h (hereinafter referred to as a medium flow rate) is required for a medium-displacement medium-power engine; and a flow rate of about 130 to 200 L/h (hereinafter referred to as a high flow rate) is required for a large-displacement high-power engine. If a fuel pump can be commonly used for various engine and vehicle types, the manufacturing costs for fuel pumps can be kept low. However, in order to avoid waste, if any, and improve the pumping efficiency in accordance with social demands such as saving of natural resources and environmental protection in recent years, a fuel pump having the minimum required discharge rate must be installed for each engine and vehicle type.

Trial products were manufactured for determining dimensions of components which are suitable for fuel pumps of discharge rates from the low flow rate to the high flow rate, by using the impeller configuration obtained on the basis of the test results explained with reference to FIGS. 10A to 10D. Now will be described these trial products and their test results to make it clear that a pumping effect which is by far superior to that of the conventional fuel pump can be obtained by slight changes in a configuration of the impeller and a configuration of the flow passage in the casing.

First, a plurality of impellers in combination with flow passage configurations specified below in Table 3 were manufactured, and their pumping efficiencies were measured.

TABLE 3

| No. | DIAMETER D | AXIAL GAP d | RADIAL GAP e | ENTIRE VANE LENGTH L2 | FLOW PASSAGE REPRESENTATIVE SIZE Rm |
|---|---|---|---|---|---|
| D12 | 30 | 0.5 | 0.7 | 2.4 | 0.57 |
| D13 | 30 | 0.55 | 0.7 | 2.4 | 0.60 |
| D14 | 30 | 0.6 | 0.7 | 2.4 | 0.64 |
| D15 | 30 | 0.65 | 0.7 | 2.4 | 0.67 |
| D16 | 30 | 0.7 | 0.7 | 2.4 | 0.70 |
| D17 | 30 | 0.75 | 0.7 | 2.4 | 0.73 |
| D18 | 30 | 0.8 | 0.7 | 2.4 | 0.76 |
| D19 | 30 | 0.85 | 0.7 | 2.4 | 0.80 |

In the trial products shown in Table 3, the flow passage representative sizes Rm were changed by changing sizes of the axial gaps d. Further, in order to vary the discharge rate from the low flow rate to the high flow rate, the rotational speed for each of the trial products was changed to be 6000 r.p.m. for the low flow rate; 7000 r.p.m. for the medium flow rate; and 8000 r.p.m. for the high flow rate. Thus, the tests were performed.

Figure 19:
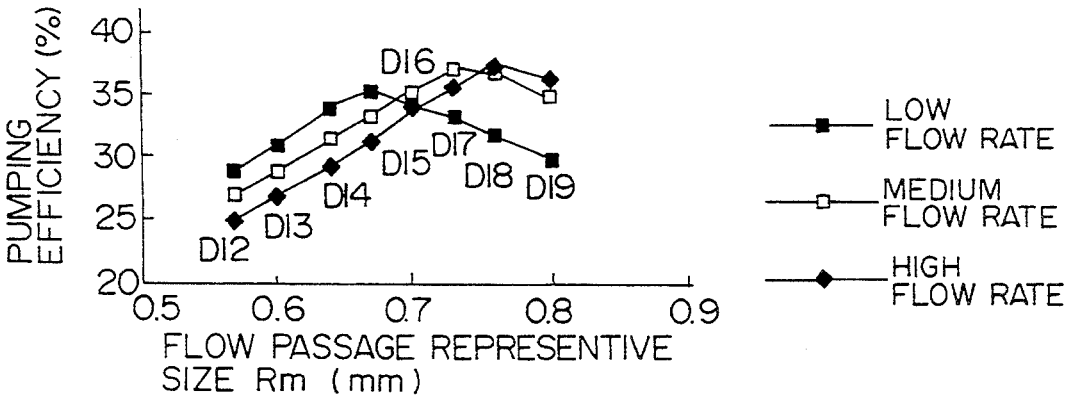
FIG. 19 is a graph illustrative of a relationship between the flow passage representative sizes Rm of fuel pumps in which impellers of the first embodiment are used, and the pumping efficiencies.

Pumping efficiencies of the trial products D12 to D19 specified in Table 3 are shown in FIG. 19. The trial product D15 (Rm 0.67) exhibited the highest efficiency at the low flow rate; the trial product D17 (Rm 0.74 ) at the medium flow rate; and the trial product D18 (Rm 0.76) at the high flow rate. That is to say, a high efficiency can be obtained by decreasing the Rm in the case of the low flow rate and increasing the Rm in the case of the high flow rate.

As for the vane shape of the impeller, the vane length L varied as shown in Table 4, and tests were performed.

TABLE 4

| No. | DIAMETER D | AXIAL GAP d | RADIAL GAP e | ENTIRE VANE LENGTH L2 | FLOW PASSAGE REPRESENTATIVE SIZE Rm |
|---|---|---|---|---|---|
| D20 | 30 | 0.7 | 0.7 | 1.6 | 0.70 |
| D21 | 30 | 0.7 | 0.7 | 1.9 | 0.70 |
| D22 | 30 | 0.7 | 0.7 | 2.1 | 0.70 |
| D23 | 30 | 0.7 | 0.7 | 2.4 | 0.70 |
| D24 | 30 | 0.7 | 0.7 | 2.7 | 0.70 |

In substantially the same manner as the previous tests, in order to vary the discharge rate from the low flow rate to the high flow rate, the rotational speed for each of the trial products was changed to be 6000 r.p.m. for the low flow rate; 7000 r.p.m. for the medium flow rate; and 8000 r.p.m. for the high flow rate. Thus, the tests were performed.

Figure 20:
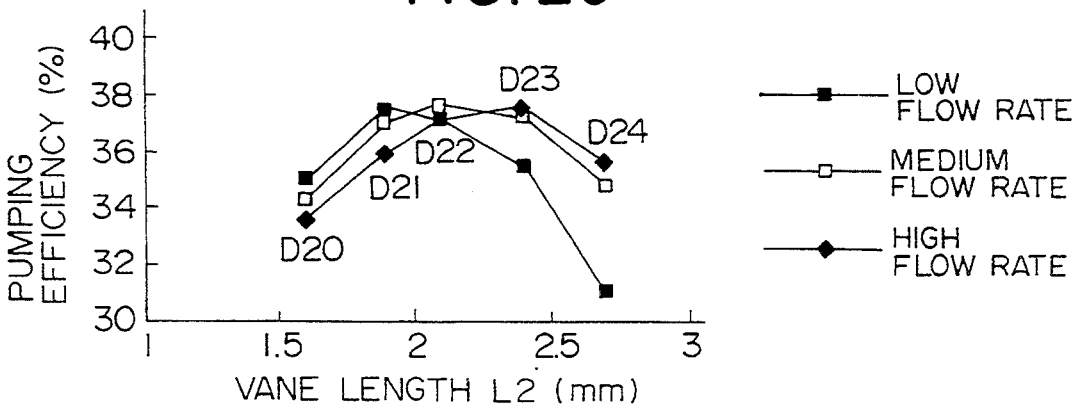
FIG. 20 is a graph illustrative of a relationship between the vane lengths L2 of the impellers of the first embodiment and the pumping efficiencies.

Pumping effects of the trial products specified in Table 4 are shown in FIG. 20. The trial product D21 exhibited the highest efficiency at the low flow rate; the trial product D22 at the medium flow rate; and the trial product D23 at the high flow rate. That is to say, a high efficiency can be obtained by decreasing the entire vane length L2 in the case of the low flow rate and increasing the entire vane length L2 in the case of the high flow rate.

It is concluded from the above-described test results that the flow passage representative size Rm or the entire vane length of the impeller is changed to make the efficiency of the fuel pump the highest with respect to the flow rate required by the engine. However, if an entire vane length of an impeller is set for each flow rate, molds of impellers as many as flow rates are necessary because the impellers are usually molded of a material such as a phenolic resin. Therefore, the entire vane length L2=2.1 mm which provides a moderately high efficiency from the low flow rate to the high flow rate is employed, and the flow passage representative size Rm is set in accordance with each of the discharge rate. The Rm is set at 0.67 for the low flow rate, and the Rm is set at 0.76 for the medium and high flow rates so that the same configuration of the flow passage is used in common.

Figure 21:
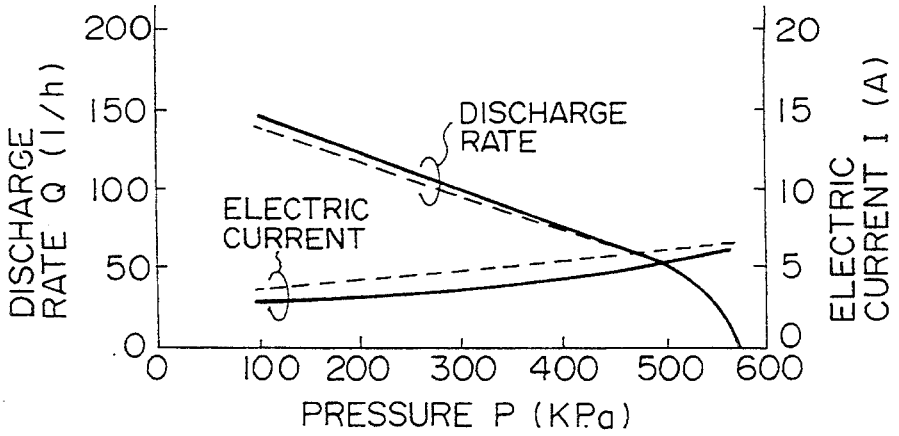
FIG. 21 is a graph illustrative of discharge-rate characteristics and electric-current characteristics of a fuel pump in which an impeller of the first embodiment is used (solid lines) and a conventional product (broken lines)

FIG. 21 shows pressure characteristics when the impeller of the first embodiment is used for a fuel pump of the medium flow rate and the Rm is set at 0.76. In this case, the required discharge rate of the fuel pump is on the same level with that of the conventional product, and the P–Q inclination need not be decreased particularly. The discharge rate is made substantially equal to that of the conventional product by changing the coil specification of the motor portion and decreasing the rotational speed. Under the effect of the invention, the pumping efficiency is improved as compared with that of the conventional fuel pump, and the electric current value can be reduced by about 1 A (about 20%). In FIG. 21, the voltage applied to the motor is constantly 12 V, and values of the pump with the impeller of the first embodiment are depicted by solid lines whereas values of a pump with a conventional impeller are depicted by broken lines.

As described so far, in a fuel pump which is required to have a discharge rate of 50 to 200 l/h under a fuel pressure of 2 to 5 kgf/cm$^2$, and which includes an impeller having a diameter of about 20 to 65 mm and a thickness t of about 2 to 5 mm, vanes whose entire length L2 is about 2 to 5 mm, and a flow passage whose representative size Rm is about 0.4 mm to 2 mm, favorable fuel flows at bottom end portions and distal end portions of vane members can be obtained by curving the vane members at a curvature radius of about 2 to 4 mm, thereby producing a high efficiency. In other words, this is the effect obtained by setting an angle $\theta 1$ of the bottom end portions at about 100° to about 127° and an angle $\theta 2$ of the distal end portions at about 45° to about 76°. Further, a vane curvature height i should preferably be 0.1 to 0.45 mm.

Moreover, a partition wall height h should preferably exceed ½ of the entire vane length L2. By setting this value, collision of flows against the curved vane surfaces is reduced to produce an even higher pumping efficiency.

Next, a manufacturing method of the impeller of the first embodiment will be explained step by step with reference to FIG. 22.

Figure 22:
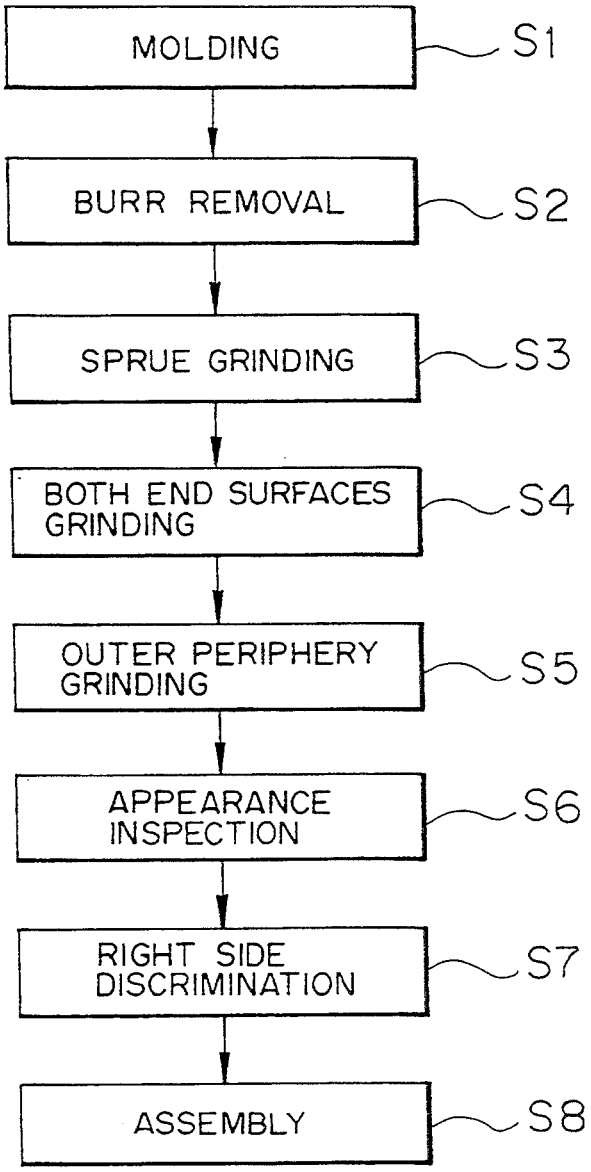
FIG. 22 is a flow chart for explaining a manufacturing process of the impeller of the first embodiment.
Figure 23:
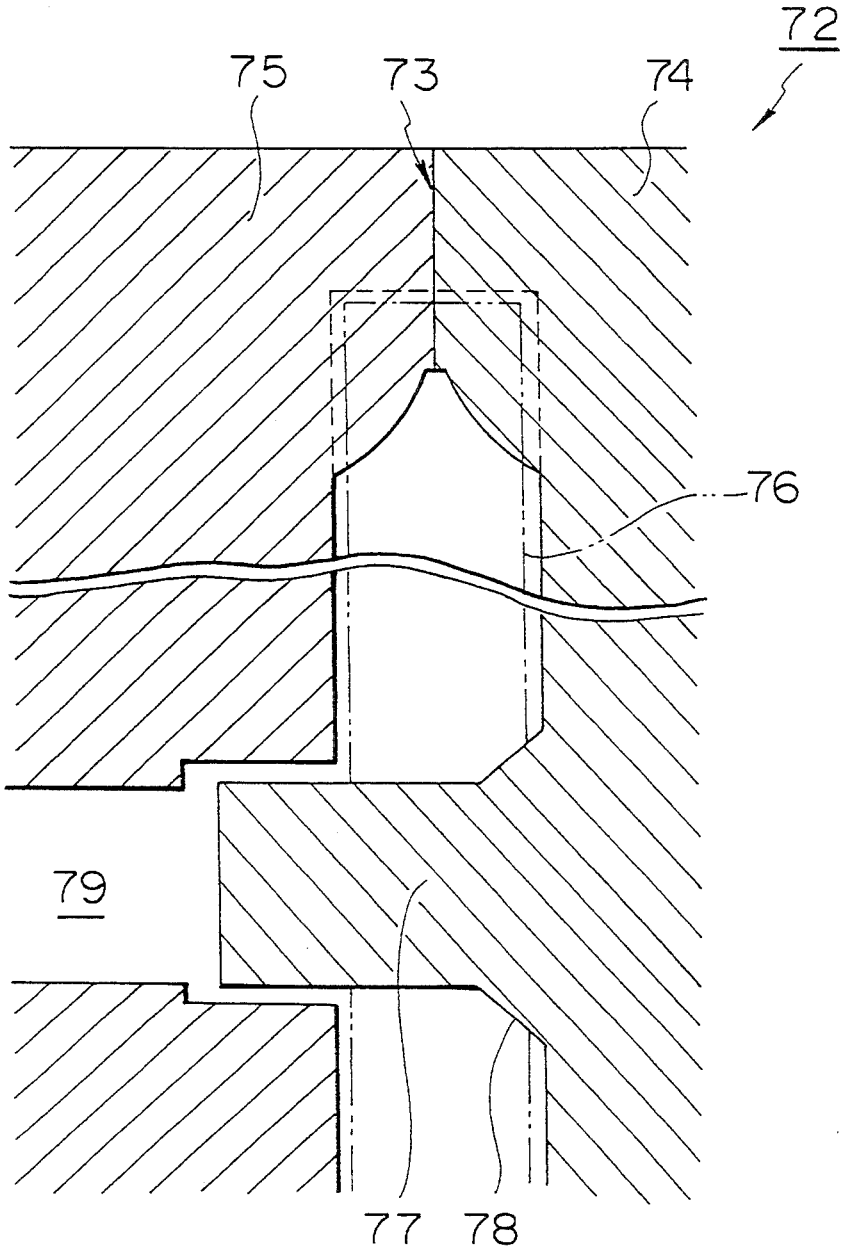
FIG. 23 is a partially omitted cross-sectional view of a mold for explaining the manufacturing process of FIG. 22.

FIG. 22 is a flow chart for explaining the impeller manufacturing process. First, in a molding step S1, an impeller is molded by injection molding or compression molding. FIG. 23 is a partially omitted cross-sectional view of a mold. The mold 72 includes mold fitting surfaces 74 for dividing the impeller 28 axially into two, and is constituted of an upper mold half 74 and a lower mold half 75. The interior of the mold 72 is formed to be slightly larger than a final shape of the impeller 28. In FIG. 23, the final shape of the impeller 28 is depicted by a chain double-dashed line 76. A column portion 77 having a D-shaped cross section for forming the fitting hole 33 is formed in the upper mold half 74 at a position corresponding to the central portion of the impeller 28, and a conical surface 78 for forming the tapered surface 33*a* is formed at the bottom end of the column portion 77. On the other hand, a sprue portion 79 for resin supply is formed in the lower mold half 75.

Figure 24:
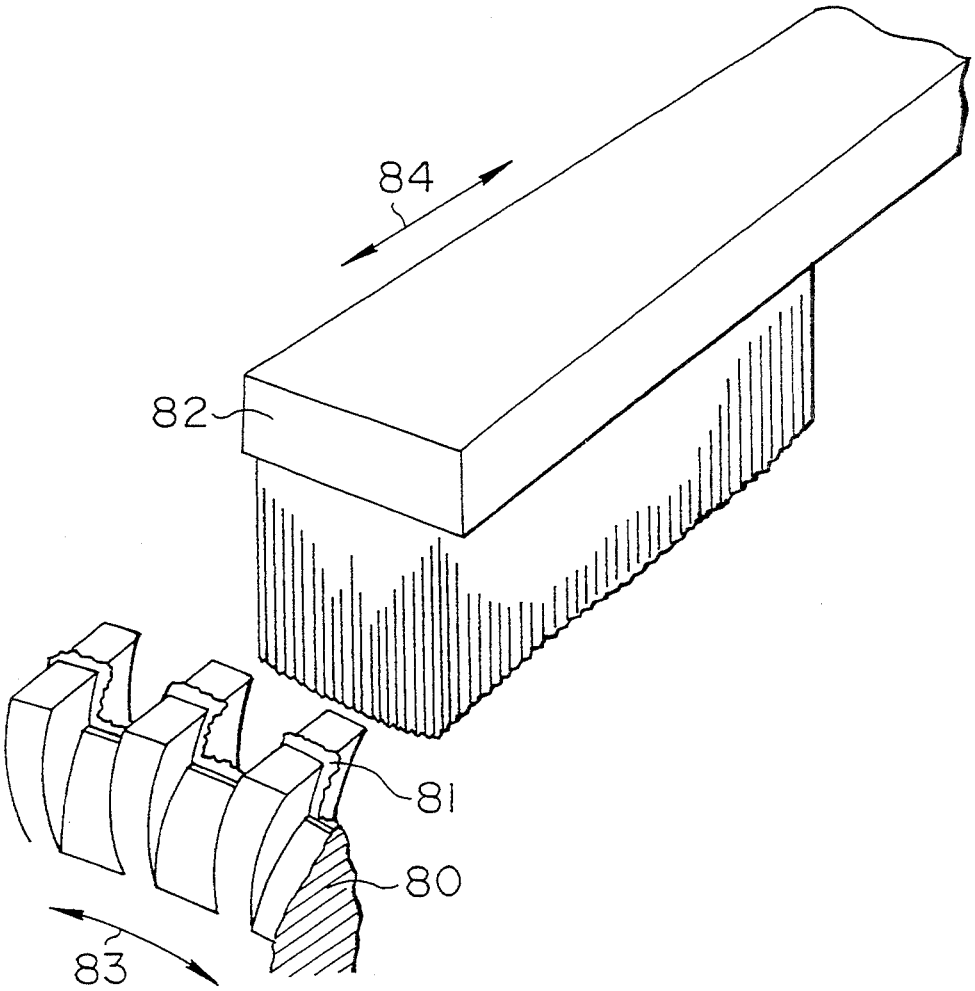
FIG. 24 is a diagram for schematically explaining a burr removal step in the manufacturing process of FIG. 22.

Next, in a burr removal step S2, burrs formed on the outer periphery of the impeller are removed. FIG. 24 is a diagram for schematically explaining the burr removal step S2. A burr 81 formed on the outer periphery of an impeller 80 along the mold fitting surfaces 74 is removed by reciprocating a metallic brush 82 in a direction indicated by an arrow 84 while rotating the impeller 80 in a direction indicated by an arrow 83.

Then, in a sprue grinding step S3, a sprue formed by the sprue portion 79 of the lower mold half 75 is removed/ground.

Figure 25:
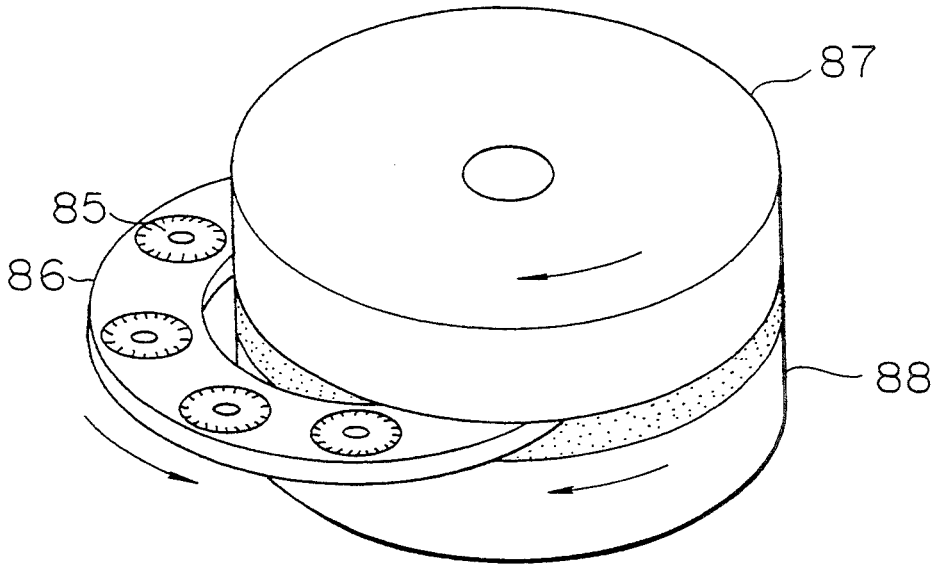
FIG. 25 is a diagram for schematically explaining a both-end-surfaces grinding step in the manufacturing process of FIG. 22.

In a both-end-surfaces grinding step S4, both end surfaces of the impeller are ground by grindstones. FIG. 25 is a diagram for schematically explaining the both-end-surfaces grinding step S4. Impellers 85 are supported on a jig 86 and passed between an upper grindstone 87 and a lower grindstone 88 so that the end surfaces on both sides will be ground. The jig 86, the upper grindstone 87 and the lower grindstone 88 are rotated in the directions indicated by the respective arrows in FIG. 25. In the both-end-surfaces grinding step S4, the impellers fixed on the jig may be ground by a surface grinder in such a manner that the end surfaces on each side will be worked.

Figure 26:
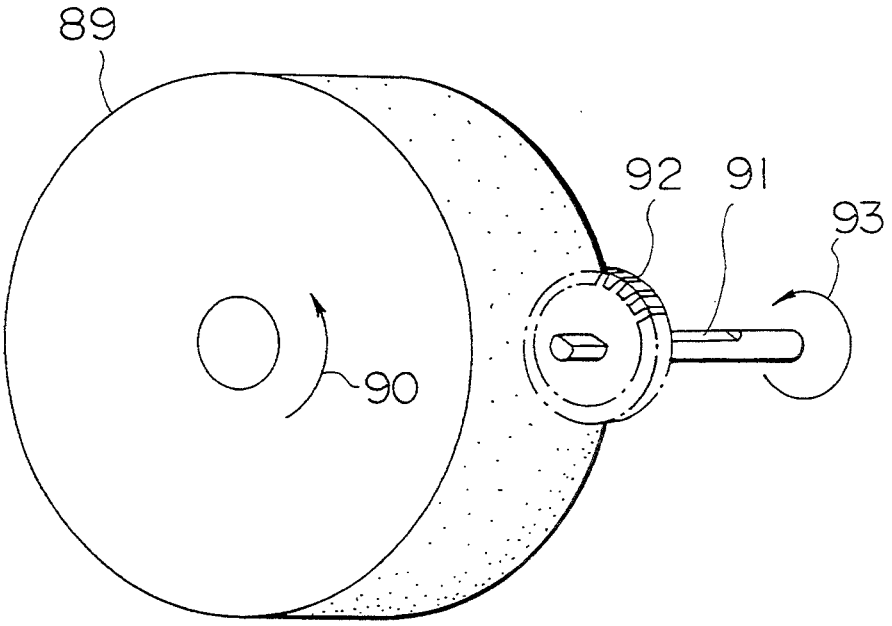
FIG. 26 is a diagram for schematically explaining an outer-periphery grinding step in the manufacturing process of FIG. 22.
Figure 27:
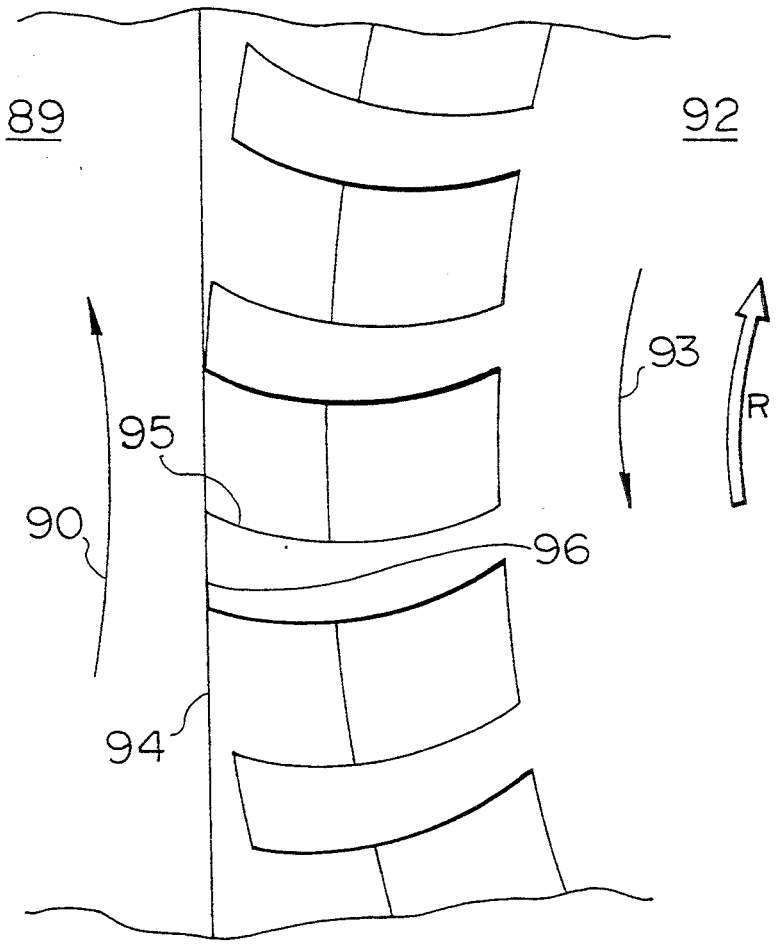
FIG. 27 is a partial, enlarged plan view for explaining the outer-periphery grinding step in the manufacturing process of FIG. 22.

Next, in an outer-periphery grinding step S5, the outer peripheral surface of an impeller is ground by a grindstone. FIG. 26 is a diagram for schematically explaining the outer-periphery grinding step S5, and FIG. 27 is a partial enlarged view of FIG. 26. The grindstone 89 is a rotary grindstone of a cylindrical shape and rotates in a direction indicated by an arrow 90. On the other hand, the impeller 92 supported on a rotational shaft 91 having a D-shaped cross section is rotated in a direction indicated by an arrow 93 which is reverse to the original rotating direction R, and is ground by the cylindrical surface of the grindstone 89. Consequently, the grinding surface 94 of the grindstone 89 moves on the distal end surface 96 of each vane member 95 in the original rotating direction of the impeller 92. Therefore, stress applied to the vane member 95 by grinding is smoothly absorbed by the curve of the vane member 95, thus reducing the breakage of the vane member 95. The impeller 92 may be rotated in the rotating direction R at a speed sufficiently lower than the rotation of the grindstone 89. Also, a plurality of impellers may be supported on the rotational shaft 91 and worked at a time. In this outer-periphery grinding step, when the distal end surface 96 of each vane member which is inclined toward the rotating direction R is ground, it is an important factor that the grinding surface 94 as a tool moves on the distal end surface 96 in the direction of inclination (R).

In the above-described manufacturing steps, the impeller 28 is formed. Then, in an appearance inspection step S6, inspection of the breakage of vane members or the like is performed, and in a right-side discrimination step S7, the right side of the impeller is discriminated. After that, in an assembly step S8, the impeller is attached in the fuel pump. In this operation, the right side of the impeller 28 can be easily discriminated by use of the tapered surface 33*a*. Besides, the tapered surface 33*a*, which is formed on the insertion side of the shaft 31 in the fitting hole 33, can facilitate insertion of the shaft 31. Moreover, wrong-side attachment of the impeller can be readily found from the easiness when the shaft 31 is inserted during the assembly and can be corrected.

Other embodiments of the invention will now be described.

Figure 28:
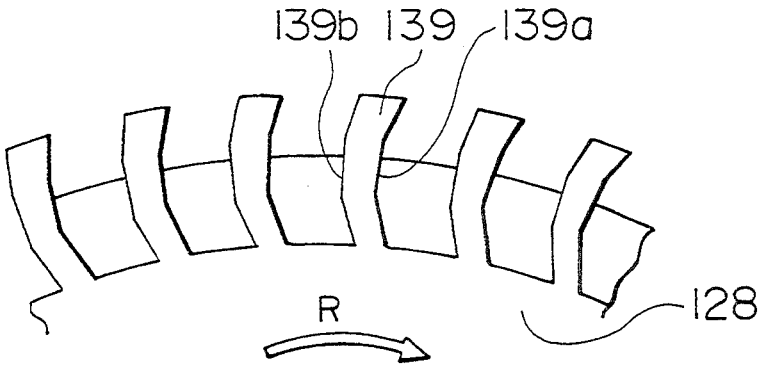
FIG. 28 is an enlarged plan view partially showing an impeller in a second embodiment of the invention.

FIG. 28 is a partial enlarged view of an impeller in a second embodiment.

Although it is preferable that vane surfaces of an impeller are curved to allow fuel to flow smoothly, each vane surface may be constituted of a plurality of plane sections like an impeller 128 shown in FIG. 28. In the second embodiment shown in FIG. 28, a vane surface 139*a*, 139*b* of each vane member 139 comprises a plane section inclined backwardly from the rotating direction R of the impeller 128, a plane section perpendicular to the rotating direction R of the impeller 128, a plane section inclined forwardly with respect to the rotating direction R of the impeller 128, in this order from the bottom end of the vane member 139. It seems important that this configuration satisfies the values described in the first embodiment except the curvature radius. Especially, an angle between the outer periphery and the bottom end of the vane surface, a depth i, the position of the distal end surface of the partition wall and so forth seem to affect the pumping function by a large degree.

Figure 29:
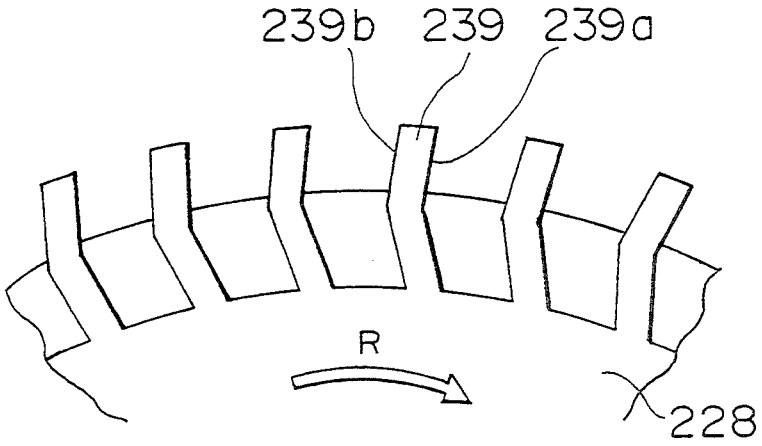
FIG. 29 is an enlarged plan view partially showing an impeller in a third embodiment of the invention.

FIG. 29 is a partial enlarged view of an impeller in a third embodiment.

In the third embodiment shown in FIG. 29, a vane surface 239*a*, 239*b* of each vane member 239 of the impeller 228 comprises a plane section inclined backwardly from the rotating direction R of the impeller 228 and a plane section inclined forwardly with respect to the rotating direction R of the impeller 128, in this order from the bottom end of the vane member 239.

Figure 30:
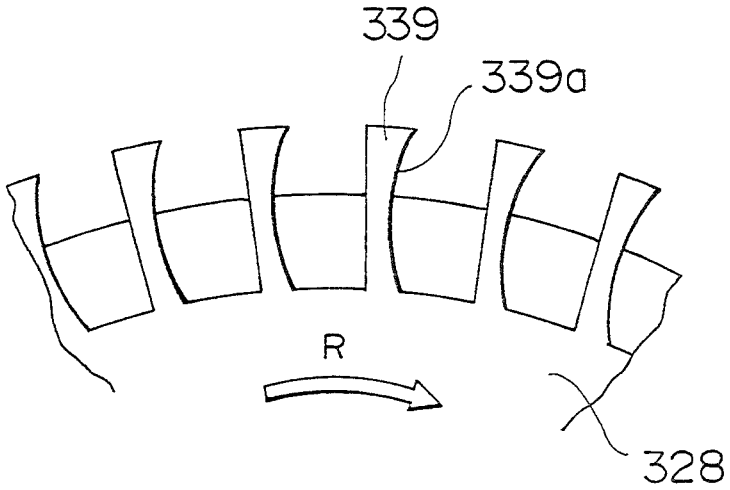
FIG. 30 is an enlarged plan view partially showing an impeller in a fourth embodiment of the invention.

FIG. 30 is a partial enlarged view of an impeller in a fourth embodiment.

Although it is preferable that both surfaces of each vane member of an impeller have the configurations specified by the invention, only upstream-side vane surfaces 339*a* are curved in the impeller 328 shown in FIG. 30.

Figure 31:
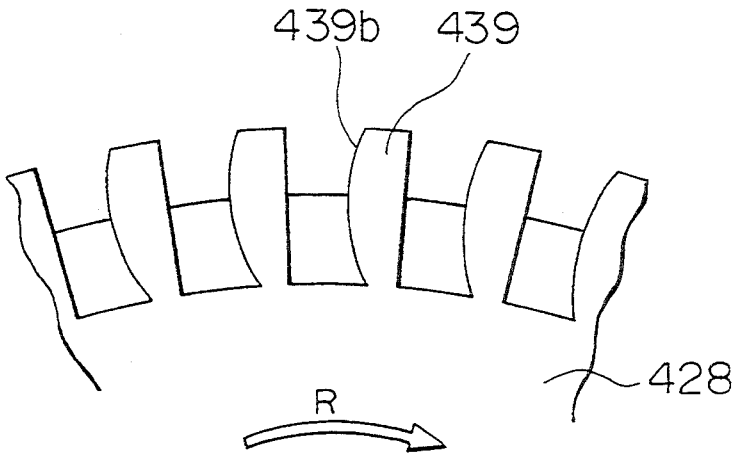
FIG. 31 is an enlarged plan view partially showing an impeller in a fifth embodiment of the invention.

FIG. 31 is a partial enlarged view of an impeller in a fifth embodiment.

In the impeller 428 shown in FIG. 31, only downstream-side vane surfaces 439*a* are curved.

Figure 32:
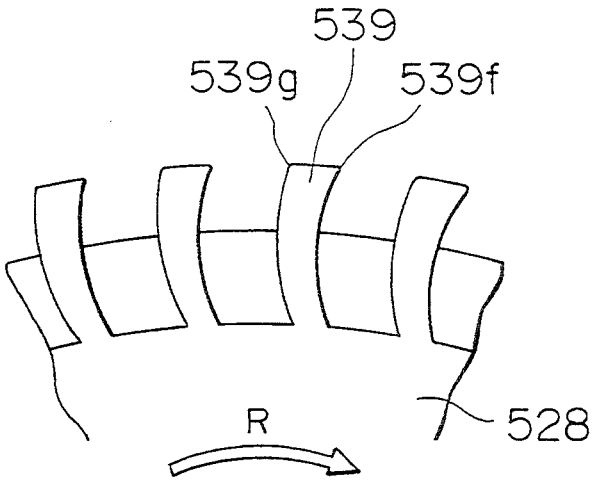
FIG. 32 is an enlarged plan view partially showing an impeller in a sixth embodiment of the invention.

FIG. 32 is a partial enlarged view of an impeller in a sixth embodiment.

In the impeller 528 shown in FIG. 32, outer peripheral corner portions 539*f* and 539*g* of each vane member 539 are shaped to have slant surfaces at the time of molding. Thus, breakage of the vane members 539 at the grinding step can be reduced.

Figure 33:
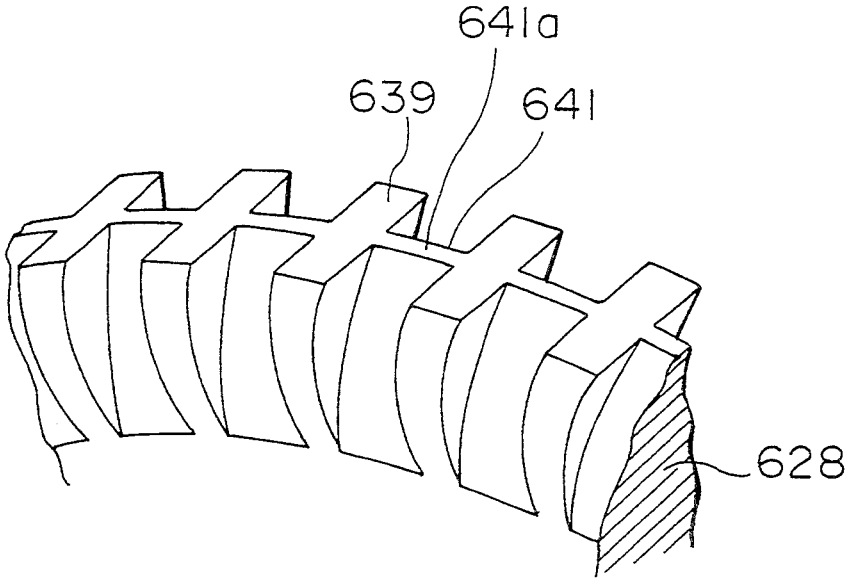
FIG. 33 is an enlarged plan view partially showing an impeller in a seventh embodiment of the invention.
Figure 34:
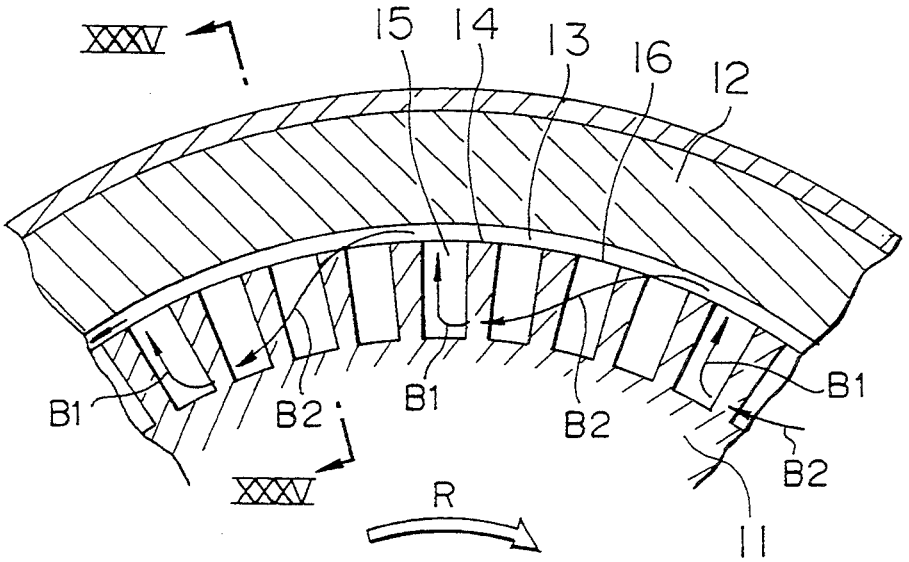
FIG. 34 PRIOR ART
FIG. 34 is an enlarged cross-sectional view showing an essential portion of a conventional fuel pump.
Figure 35:
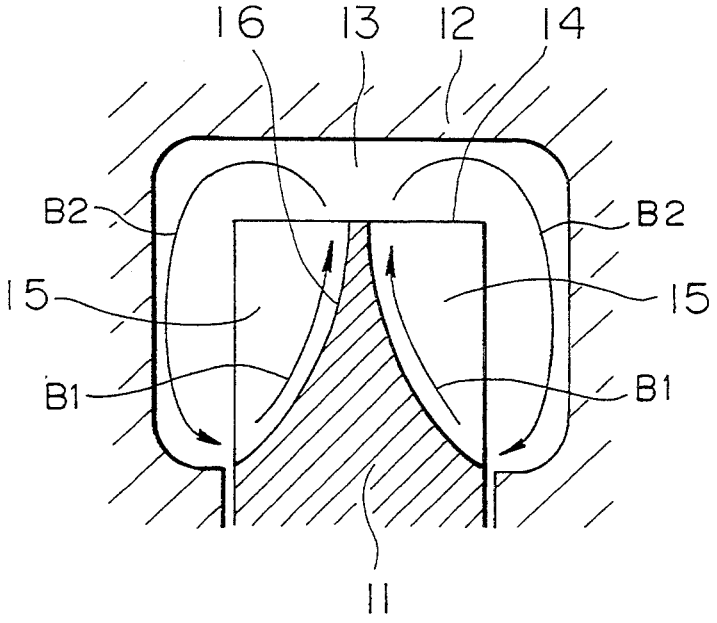
FIG. 35 PRIOR ART
FIG. 35 is an enlarged cross-sectional view showing the essential portion of the conventional fuel pump, taken along the line XXXV—XXXV of FIG. 34.

FIG. 33 is a partial enlarged view of an impeller in a seventh embodiment.

In the impeller 628 shown in FIG. 33, vane members 639 have the same shape and size as the vane members 39 of the first embodiment. However, a distal end surface 641*a* of each partition wall 641 extends to the outer periphery of the vane members 639. Consequently, in the seventh embodiment, not only the outer peripheral surfaces of the vane members 639 but also the distal end surfaces 641*a* of the partition walls 641 are simultaneously ground in the outer-periphery grinding step.

Other than the above-described embodiments, various modifications can be effected within the spirit of the present invention. For instance, the curvature center of the vane members can be slightly moved from that of the first embodiment, or the vane surfaces can be formed to have an elliptic shape.

Further, the present invention will not be limited to a fuel pump for an automobile and can be widely applied as a pump for supplying various kinds of fluids, such as water, under a pressure.

According to the invention, as clearly understood from the above description, the bottom end portion of each vane member is inclined backwardly from the rotating direction of the impeller, so that the angle defined between the whirling flow entering into the vane groove from the side surface of the impeller, and the bottom end portion of the vane member is decreased to allow the whirling flow to enter into the vane groove smoothly. Also, since the distal end side of each vane member is inclined forwardly with respect to the rotating direction, the vane member can effectively apply kinetic energy to move toward the discharge port, to the fluid which has flowed into the vane groove, thereby enhancing the pumping efficiency to a further degree.

Moreover, according to the manufacturing method of the impeller of this invention, the impeller can be manufactured while decreasing the breakage of vane members even if the impeller is molded of a resin.

What is claimed is:

1. A regenerative pump comprising:

a casing including a suction port, a discharge port and a pump flow passage of an arcuate shape connecting these ports; and a disk-like impeller rotatably housed in said casing and formed with a number of vane members at a position corresponding to said pump flow passage, each said vane members having upstream-side and downstream-side vane surfaces, wherein at least one of said upstream-side and downstream-side vane surfaces of each of the vane members comprises a section located on a bottom end side of said vane member and inclined backwardly from a rotating direction of said impeller, and another section located on an outer peripheral side of said vane member and inclined forwardly with respect to the rotating direction of said impeller.

2. A regenerative pump according to claim 1, wherein said impeller includes partition walls, each of which divides a groove between adjacent two of said vane members into a first groove section facing one end surface of said impeller, a second groove section facing another end surface of said impeller, and a communication groove section which connects said first and second groove sections in an axial direction substantially only at the outer peripheral side.

3. A regenerative pump according to claim 2, wherein distal end surfaces of said partition walls are inclined forwardly with respect to the rotating direction of said impeller and located in areas on the outer peripheral side of said vane members.

4. A regenerative pump according to claim 1, wherein an end portion of each of said vane surfaces at the bottom side and another end portion of said vane surface at the outer peripheral side are located substantially on a diametral line passing through a center of said impeller.

5. A regenerative pump according to claim 4, wherein said impeller is formed to have an impeller diameter of 20 to 65 mm, an impeller thickness of 2 to 5 mm, an entire vane length of 2 to 5 mm, and a vertical depth of 0.1 to 0.45 mm, said vertical depth being defined from a straight line connecting the end portions of said vane surface at the bottom side and the outer peripheral side, to a deepest portion of said vane surface.

6. A regenerative pump according to claim 4, wherein said vane surfaces are curved.

7. A regenerative pump according to claim 6, wherein said impeller is formed to have an impeller diameter of 20 to 65 mm, an impeller thickness of 2 to 5 mm, an entire vane length of 2 to 5 mm, and a curvature radius of said vane surface of 2 to 4 mm.

8. A regenerative pump according to claim 4, wherein each of said vane surfaces is formed of a combination of a plurality of plane sections.

9. A regenerative pump according to claim 1, wherein the plane section located on the bottom end side of each of said vane members is inclined at an angle of 100° to 127° backwardly from the rotating direction of said impeller, and the plane section located on the outer peripheral side of said vane member is inclined at an angle of 45° to 76° forwardly with respect to the rotating direction of said impeller.

10. A regenerative pump according to claim 9, wherein said impeller includes partition walls each of which divides a groove between adjacent two of said vane members into a first groove section facing an end surface of said impeller, a second groove section facing another end surface of said impeller, and a communication groove section which connects said first and second groove sections in an axial direction substantially only at the outer peripheral side, and a height h of said partition walls when an entire vane length is expressed by L2 satisfies a relation of $$L2/2 < h \leq L2.$$

11. A regenerative pump according to claim 10, wherein said impeller is formed to have an impeller diameter of 20 to 65 mm, an impeller thickness of 2 to 5 mm, an entire vane length of 2 to 5 mm, and a flow passage representative size of 0.4 to 2 mm, said flow passage representative size being defined from a relation with said pump flow passage.

12. A regenerative pump according to claim 11, wherein both the upstream-side and downstream-side vane surfaces of each of said vane members have substantially the same configuration.

13. A regenerative pump according to claim 12, wherein an end portion of each of said vane surfaces at the bottom side and another end portion of said vane surface at the outer peripheral side are located substantially on a diametral line passing through a center of said impeller.

14. A regenerative pump according to claim 13, which is applied to a fuel injection device for injecting and supplying fuel to an internal combustion engine for a vehicle, and is a fuel pump installed in a fuel tank and driven by an electric motor so as to supply the fuel from the fuel tank under a pressure, wherein said regenerative pump is designed to discharge the fuel at a rate of 50 to 200 l/h under a discharge pressure of 2 to 5 $kgf/cm^2$.

15. A regenerative pump according to claim 14, wherein said impeller includes a fitting hole in which a rotational shaft of said electric motor is inserted to transmit rotation, and a tapered surface which is formed on said fitting hole on an electric motor side.

16. A fluid pump comprising:

a housing having a fluid intake port and a fluid discharge port, said housing defining a fluid flow passage;

an impeller rotatably disposed in said housing, said impeller having a plurality of circumferentially spaced apart and radially extending vane members, each said vane member having a downstream surface and an upstream surface relative to a rotational direction of said impeller, wherein at least one of said upstream surface and said downstream surface of each vane member has a radially proximal portion which is inclined in a direction opposite an operational rotation direction of the impeller and a radially distal portion which is inclined in a direction toward the operational rotation direction, said impeller further including radially extending partitions extending between adjacent vane members, wherein each said partition extends in a radial direction farther than a boundary between said oppositely inclined proximal and distal portions of said vane members; and a motive device for rotating said impeller.

17. A regenerative pump comprising:

a casing including a suction port, a discharge port and a pump flow passage of an arcuate shape connecting these ports; and a disk-like impeller rotatably housed in said casing and formed with a number of vane members at a position corresponding to said pump flow passage, wherein said impeller is formed in a manner that at least one of upstream-side and downstream-side vane surfaces of each of the vane members comprises a plane section located on a bottom end side of said vane member and inclined backwardly from a rotating direction of said impeller, and another plane section located on an outer peripheral side of said vane member and inclined forwardly with respect to the rotating direction of said impeller.

18. A regenerative pump according to claim 17, wherein said impeller includes partition walls each of which divides a groove between adjacent two of said vane members into a first groove section facing one end surface of said impeller, a second groove section facing another end surface of said impeller, and a communication groove section which connects said first and second groove sections in an axial direction substantially only at the outer peripheral side.

19. A regenerative pump according to claim 18, wherein distal end surfaces of said partition walls are inclined forwardly with respect to the rotating direction of said impeller and located in areas on the outer peripheral side of said vane members.

20. A regenerative pump according to claim 17, wherein an end portion of each of said vane surfaces at the bottom side and another end portion of said vane surface at the outer peripheral side are located substantially on a diametral line passing through a center of said impeller.

21. A regenerative pump according to claim 20, wherein said impeller is formed to have an impeller diameter of 20 to 65 mm, an impeller thickness of 2 to 5 mm, an entire vane length of 2 to 5 mm, and a vertical depth of 0.1 to 0.45 mm, said vertical depth being defined from a straight line connecting the end portions of said vane surface at the bottom side and the outer peripheral side, to a deepest portion of said vane surface.

22. A regenerative pump according to claim 20, wherein said vane surfaces are curved.

23. A regenerative pump according to claim 22, wherein said impeller is formed to have an impeller diameter of 20 to 65 mm, an impeller thickness of 2 to 5 mm, an entire vane length of 2 to 5 mm, and a curvature radius of said vane surface of 2 to 4 mm.

24. A regenerative pump according to claim 20, wherein each of said vane surfaces is formed of a combination of a plurality of plane sections.

25. A regenerative pump according to claim 17, wherein the plane section located on the bottom end side of each of said vane members is inclined at an angle of 100° to 127° backwardly from the rotating direction of said impeller, and the plane section located on the outer peripheral side of said vane member is inclined at an angle of 45° to 76° forwardly with respect to the rotating direction of said impeller.

26. A regenerative pump according to claim 25, wherein said impeller includes partition walls each of which divides a groove between adjacent two of said vane members into a first groove section facing an end surface of said impeller, a second groove section facing another end surface of said impeller, and a communication groove section which connects said first and second groove sections in an axial direction substantially only at the outer peripheral side, and a height h of said partition walls when an entire vane length is expressed by L2 satisfies a relation of $$L2/2 < h \leqq L2.$$

27. A regenerative pump according to claim 26, wherein said impeller is formed to have an impeller diameter of 20 to 65 mm, an impeller thickness of 2 to 5 mm, an entire vane length of 2 to 5 mm, and a flow passage representative size of 0.4 to 2 mm, said flow passage representative size being defined from a relation with said pump flow passage.

28. A regenerative pump according to claim 27, wherein both the upstream-side and downstream-side vane surfaces of each of said vane members have substantially the same configuration.

29. A regenerative pump according to claim 28, wherein an end portion of each of said vane surfaces at the bottom side and another end portion of said vane surface at the outer peripheral side are located substantially on a diametral line passing through a center of said impeller.

30. A regenerative pump according to claim 29, which is applied to a fuel injection device for injecting and supplying fuel to an internal combustion engine for a vehicle, and is a fuel pump installed in a fuel tank and driven by an electric motor so as to supply the fuel from the fuel tank under a pressure, wherein said regenerative pump is designed to discharge the fuel at a rate of 50 to 200 l/h under a discharge pressure of 2 to 5 $kgf/cm^2$.

31. A regenerative pump according to claim 30, wherein said impeller includes a fitting hole in which a rotational shaft of said electric motor is inserted to transmit rotation, and a tapered surface which is formed on said fitting hole on an electric motor side.

32. A fuel pump for provision in a fuel tank of an automobile to pressurize and supply fuel to an internal combustion engine, comprising:

a cylindrical housing;

a pump portion which is provided on one end of said housing and draws fuel from the fuel tank and discharges the fuel into said housing;

a motor portion which is provided in said housing and drives said pump portion; and a fuel discharge port which is provided on another end of said housing and discharges the fuel which has been discharged from said pump portion and passed inside of said housing, said pump portion comprising:

a casing in which a pump flow passage of an arcuate shape is formed, said pump flow passage including a suction port which is formed on one end thereof and communicates with the fuel tank, and a discharge port which is formed on another end thereof and communicates with the inside of said housing; and a disk-like impeller which is rotatably housed in said casing and driven for rotation by said motor portion, said impeller comprising:

a plurality of individual vane members between which vane grooves are formed, each of said vane members including a vane surface facing a downstream side of said pump flow passage and another vane surface facing an upstream side of said pump flow passage, said downstream-side vane surface and said upstream-side vane surface being curved in a manner that portions of the vane surfaces on an bottom end side of said vane member are inclined backwardly from a rotating direction of said impeller, and that portions of the vane surfaces on an outer peripheral side of said vane member are inclined forwardly with respect to the rotating direction of said impeller; and partition walls each of which divides a vane groove between adjacent two of said vane members into a first groove section facing an end surface of said impeller, a second groove section facing another end surface of said impeller, and a communication groove section which connects said first and second groove sections axially at the outer peripheral side.

33. A fuel pump according to claim 32, wherein a height h of said partition walls when an entire vane length is expressed by L2 satisfies a relation of $L2/2 < h \leqq L2$.

34. A fuel pump according to claim 33, wherein the portions of said vane surfaces on the bottom end side are inclined at an angle of 100° to 127° backwardly from the rotating direction of said impeller, and the portions of said vane surfaces on the outer peripheral side are inclined at an angle of 45° to 76° forwardly with respect to the rotating direction of said impeller.

35. A fuel pump according to claim 34, wherein the end portion of each of said vane surfaces at the bottom side and the end portion of said vane surface at the outer peripheral side are located substantially on a diametral line passing through a center of said impeller.

36. A fuel pump according to claim 35, wherein said impeller is formed to have an impeller diameter of 20 to 65 mm, an impeller thickness of 2 to 5 mm, a curvature radius of said vane surfaces of 2 to 4 mm, an entire vane length of 2 to 5 mm, and a flow passage representative size of 0.4 to 2 mm, said flow passage representative size being defined from a relation with said pump flow passage.

* * * * *